US007708054B2

(12) United States Patent
Watanabe et al.

(10) Patent No.: US 7,708,054 B2
(45) Date of Patent: May 4, 2010

(54) HEAT EXCHANGER

(75) Inventors: Hirohiko Watanabe, Oyama (JP); Kouta Arino, Oyama (JP)

(73) Assignee: Showa Denko K.K., Tokyo (JP)

( * ) Notice: Subject to any disclaimer, the term of this patent is extended or adjusted under 35 U.S.C. 154(b) by 1079 days.

(21) Appl. No.: 10/566,651

(22) PCT Filed: Jul. 30, 2004

(86) PCT No.: PCT/JP2004/011309

§ 371 (c)(1),
(2), (4) Date: Feb. 1, 2006

(87) PCT Pub. No.: WO2005/012823

PCT Pub. Date: Feb. 10, 2005

(65) Prior Publication Data

US 2007/0144721 A1 Jun. 28, 2007

Related U.S. Application Data

(60) Provisional application No. 60/497,338, filed on Aug. 25, 2003, provisional application No. 60/555,706, filed on Mar. 24, 2004.

(30) Foreign Application Priority Data

Aug. 1, 2003 (JP) ..... 2003-284870
Mar. 17, 2004 (JP) ..... 2004-076670

(51) Int. Cl.
*F28F 9/02* (2006.01)
*F28D 1/02* (2006.01)

(52) U.S. Cl. ..... 165/176; 165/174

(58) Field of Classification Search ..... 165/173–178, 165/153; 29/890.03, 890.043, 890.052
See application file for complete search history.

(56) References Cited

U.S. PATENT DOCUMENTS 3,893,611 A * 7/1975 Chartet ..... 228/44.3

(Continued)

FOREIGN PATENT DOCUMENTS

CN 1225717 A 8/1999

(Continued)

OTHER PUBLICATIONS

U.S. Appl. No. 11/909,223, filed Sep. 20, 2007, Arino, et al.

*Primary Examiner*—Tho V Duong
(74) *Attorney, Agent, or Firm*—Oblon, Spivak, McClelland, Maier & Neustadt, L.L.P.

(57) ABSTRACT

A heat exchanger includes a heat exchange core including a plurality of heat exchange tubes, a refrigerant inlet header and a refrigerant outlet header arranged toward one end of each heat exchange tube, and a refrigerant inflow header and a refrigerant outflow header arranged toward the other end of each heat exchange tube. The outlet header has an interior divided into two spaces by a flow dividing resistance plate, and some of the heat exchange tubes are joined to the outlet header so as to communicate with the space. The resistance plate has a plurality of refrigerant passing holes formed therein that are different in shape and/or size. The outlet header is provided on the outer surface thereof with identification marks for discriminating the positions of the refrigerant passing holes and representing the shapes and/or sizes of the holes.

5 Claims, 14 Drawing Sheets

U.S. PATENT DOCUMENTS 5,152,339 A * 10/1992 Calleson ..... 165/173
5,450,896 A * 9/1995 Bertva et al. ..... 165/173
5,685,366 A * 11/1997 Voss et al. ..... 165/144
5,934,367 A * 8/1999 Shimmura et al. ..... 165/174
6,082,448 A * 7/2000 Haussmann ..... 165/174
6,540,016 B1 * 4/2003 Baldantoni ..... 165/173
6,745,827 B2 * 6/2004 Lee et al. ..... 165/144
2003/0159813 A1 * 8/2003 Baldantoni ..... 165/140

FOREIGN PATENT DOCUMENTS

JP 55-3172 1/1980
JP 9-89484 4/1997
JP 2003-75024 3/2003

* cited by examiner

HEAT EXCHANGER

CROSS REFERENCE TO RELATED APPLICATIONS

This application is an application filed under 35 U.S.C. §111(a) claiming the benefit pursuant to 35 U.S.C. §119(e)(1) of the filing date of Provisional Applications No. 60/497,338 and No. 60/555,706 filed Aug. 25, 2003 and Mar. 24, 2004, respectively, pursuant to 35 U.S.C. §111(b).

TECHNICAL FIELD

The present invention relates to heat exchangers, and more particularly to heat exchangers for use as evaporators in motor vehicle air conditioners which are refrigeration cycles to be installed in motor vehicles.

The downstream side (the direction indicated by the arrow X in FIGS. 1 and 10, and the right-hand side of FIGS. 3 and 11) of the air to be passed through the air flow clearance between each adjacent pair of heat exchange tubes will be referred to herein and in the appended claims as "front," and the opposite side as "rear."

BACKGROUND ART

Heretofore in wide use as motor vehicle evaporators are those of the so-called stacked plate type which comprise a plurality of flat hollow bodies arranged in parallel and each composed of a pair of dishlike plates facing toward each other and brazed to each other along peripheral edges thereof, and a louvered corrugated fin disposed between and brazed to each adjacent pair of flat hollow bodies. In recent years, however, it has been demanded to provide evaporators further reduced in size and weight and exhibiting higher performance.

To meet such a demand, the present applicant has already proposed evaporators which comprise a first and a second header tank arranged as spaced apart from each other, and a heat exchange core provided between the two header tanks, each of the two header tanks having a front portion and a rear portion which are symmetric in cross sectional contour, the first header tank having its interior divided by a partition wall with respect to the direction of flow of air through the evaporator into a refrigerant inlet header positioned downstream with respect to the direction of flow of air and a refrigerant outlet header positioned upstream with respect to the direction of flow of air, the outlet header having its interior divided into upper and lower two spaces by a flow dividing resistance plate formed integrally with the outlet header, the resistance plate being provided with a plurality of refrigerant passing holes, the second header tank having its interior divided by a partition wall with respect to the direction of flow of air into a refrigerant inflow header positioned downstream with respect to the direction of flow of air and a refrigerant outflow header positioned upstream with respect to the direction of flow of air, the heat exchange core comprising tube groups in the form of a plurality of rows arranged in the direction of flow of air and each comprising a plurality of heat exchange tubes arranged at a spacing longitudinally of the tanks, the heat exchange tubes of at least one tube group having opposite ends joined respectively to the inlet header and the inflow header, the heat exchange tubes of another tube group having opposite ends joined respectively to the outlet header and the outflow header (see the publication of JP-A No. 2003-75024). The evaporator is fabricated by tacking the components in combination and brazing the tacked assembly collectively.

With this evaporator, the flow dividing resistance plate functions to permit the refrigerant to flow through all the heat exchange tubes of the tube groups in uniform quantities, thereby enabling the evaporator to exhibit improved heat exchange performance.

However, the front and rear portions of the first header tank are symmetric in cross sectional contour, and the flow dividing resistance plate can not be recognized from outside, so that in assembling the components for the fabrication of the evaporator, it is likely that the header tank will be incorporated into the assembly, as oriented longitudinally in the opposite direction. It is then almost impossible to obtain the effect to cause the refrigerant to flow through all the heat exchange tubes in uniform quantities, and there is the likelihood of the evaporator exhibiting greatly impaired refrigeration performance.

Further in order to uniformalize the quantities of refrigerant to be passed through all the heat exchange tubes, it is likely that a plurality of refrigerant passing holes which are different in shape and/or size will be formed in the flow dividing resistance plate asymmetrically longitudinally of the refrigerant outlet header as shown in FIGS. 15 and 16 of the above publication.

However, since the positions of the refrigerant passing holes can not be recognized from outside in assembling the components for the fabrication of the evaporator, the resistance plate is likely to be incorporated as oriented longitudinally in the opposite direction into the assembly. It is then almost impossible to obtain the effect to cause the refrigerant to flow through all the heat exchange tubes in uniformalized quantities, and the evaporator will exhibit seriously impaired refrigeration performance.

An object of the present invention is to overcome the above problems and to provide a heat exchanger which is outstanding in heat exchange performance.

DISCLOSURE OF THE INVENTION

To fulfill the above object, the present invention comprises the modes to be described below.

1) A heat exchanger comprising two headers arranged as spaced apart from each other, and a plurality of heat exchange tubes arranged in parallel between the two headers and having opposite ends joined to the respective headers, at least one of the headers having interior divided into two spaces by a flow dividing resistance plate, the heat exchange tubes being joined to said at least one header so as to communicate with one of the spaces, the resistance plate having a refrigerant passing hole formed therein, the header having the resistance plate being provided on an outer surface thereof with an identification mark for discriminating the position of the refrigerant passing hole.

2) A heat exchanger described in par. 1) wherein the flow dividing resistance plate has a plurality of refrigerant passing holes formed therein and different in shape and/or size, and the header having the resistance plate is provided on the outer surface thereof with identification marks representing the shapes and/or sizes of the respective holes in addition to the positions of the respective holes.

3) A heat exchanger described in par. 2) wherein the identification marks are provided respectively at positions corresponding to the respective holes, and are different in accordance with the shapes and/or sizes of the holes.

4) A heat exchanger described in par. 1) wherein the identification mark comprises a recess formed in the header outer surface.

5) A heat exchanger described in par. 1) wherein the identification mark comprises a projection formed on the header outer surface.

6) A heat exchanger described in par. 1) which comprises a heat exchange core composed of tube groups in the form of a plurality of rows arranged forward or rearward and each comprising a plurality of heat exchange tubes arranged at a spacing, a refrigerant inlet header positioned toward one end of each heat exchange tube and disposed at a front side, the inlet header having joined thereto the heat exchange tubes of the tube group of at least one row, a refrigerant outlet header disposed toward said one end of each heat exchange tube and in the rear of the inlet header, the outlet header having joined thereto the heat exchange tubes of the tube group of at least one row, a refrigerant inflow header disposed toward the other end of each heat exchanger and having joined thereto the heat exchange tubes joined to the inlet header, and a refrigerant outflow header disposed toward said other end of each heat exchange tube and in the rear of the inflow header, the outflow header having joined thereto the heat exchange tubes joined to the outlet header, the outflow header being in communication with the inflow header, the outlet header having interior divided into two spaces by the flow dividing resistance plate.

7) A heat exchanger described in par. 6) wherein the inlet header and the outlet header are integral, and the inlet header and the outlet header are provided by dividing interior of one header tank by a partition wall.

8) A heat exchanger described in par. 7) wherein the header tank comprises a first member having the heat exchange tubes joined thereto, and a second member brazed to the first member at a portion thereof opposite to the heat exchange tubes, the partition wall and the resistance plate being formed integrally with the second member, the identification mark being provided on an outer surface of the second member.

9) A process for fabricating a heat exchanger described in par. 8) which includes extruding the second member having the partition wall and the resistance plate, and subjecting the extruded second member to press work to form the refrigerant passing hole in the resistance plate and provide the identification mark on the outer surface of the second member at the same time.

10) A refrigeration cycle comprising a compressor, a condenser and an evaporator, the evaporator being a heat exchanger described in any one of par. 1) to 8).

11) A vehicle having installed therein a refrigeration cycle described in par. 10) as an air conditioner.

12) A header tank for use in heat exchangers which has a front portion and a rear portion which are asymmetric in cross sectional contour.

13) A header tank for use in heat exchangers described in par. 12) wherein at least an outer portion of the header tank is made of an extrudate member, and the extrudate member is integrally provided with a ridge positioned on an outer surface of the member away from a center thereof with respect to the forward or rearward direction and extending longitudinally thereof, the extrudate member having a front portion and a rear portion which are symmetric except the ridge in cross sectional contour.

14) A header tank for use in heat exchangers described in par. 13) which comprises a first member to be joined to heat exchange tubes, and a second member to be brazed to the first member at a portion thereof opposite to the heat exchange tubes, the second member being the extrudate member having the ridge.

15) A heat exchanger comprising a first and a second header tank arranged as spaced apart from each other, and a plurality of heat exchange tubes arranged in parallel between the two header tanks and having opposite ends joined to the respective header tanks, at least one of the header tanks having a front portion and a rear portion which are asymmetric in cross sectional contour.

16) A heat exchanger described in par. 15) wherein the header tank having the front portion and the rear portion which are asymmetric in cross sectional contour has at least an outer portion made of an extrudate member, and the extrudate member is integrally provided with a ridge positioned on an outer surface of the member away from a center thereof with respect to the forward or rearward direction and extending longitudinally thereof, the extrudate member having a front portion and a rear portion which are symmetric except the ridge in cross sectional contour.

17) A heat exchanger described in par. 16) wherein the header tank having the front portion and the rear portion which are asymmetric in cross sectional contour comprises a first member having the heat exchange tubes joined thereto, and a second member brazed to the first member at a portion thereof opposite to the heat exchange tubes, the second member being the extrudate member having the ridge.

18) A heat exchanger described in par. 15) which comprises a first and a second header tank arranged as spaced apart from each other, and a plurality of heat exchange tubes arranged in parallel between the two header tanks and having opposite ends joined to the respective header tanks, the first header tank having interior divided by a partition wall into a front and a rear portion to provide a refrigerant inlet header and a refrigerant outlet header respectively, the second header tank having interior divided by a partition wall into a front and a rear portion to provide two intermediate headers, some of the heat exchange tubes being arranged in parallel between the inlet header and one of the intermediate headers and having opposite ends joined to the respective headers, the other heat exchange tubes being arranged in parallel between the outlet header and the other intermediate header and having opposite ends joined to the respective headers.

19) A heat exchanger described in par. 18) wherein each of the header tanks comprises a first member having the heat exchange tubes joined thereto and a second member made of an extrudate and brazed to the first member at a portion thereof opposite to the heat exchange tubes, and the second member of at least one of the header tanks is integrally provided with a ridge positioned on an outer surface of the second member away from a center thereof with respect to the forward or rearward direction and extending longitudinally thereof, the second member having a front portion and a rear portion which are symmetric except the ridge in cross sectional contour.

20) A heat exchanger described in par. 19) wherein the ridge is provided on the outer surface of the second member of the first header tank, and the outlet header has interior partitioned into two spaces by a flow dividing resistance plate, said other heat exchange tubes being joined to the outlet header in communication with one of the spaces, the resistance plate having a refrigerant passing hole formed therein, the partition wall and the resistance plate being formed integrally with the second member.

21) A process for fabricating a heat exchanger described in par. 15) which is characterized by including assembling the header tanks as held by a jig and the heat exchange tubes, the jig having a recessed portion for an outer portion of each header tank to fit in.

22) A process for fabricating a heat exchanger described in par. 16) or 19) which is characterized by including assembling the header tanks as held by a jig and the heat exchange tubes, the jig having a recessed portion for an outer portion of each header tank to fit in, the recessed portion for at least one of the header tanks having a groove formed in an inner peripheral surface thereof and extending longitudinally thereof for the ridge to fit in.

23) A refrigeration cycle comprising a compressor, a condenser and an evaporator, the evaporator being a heat exchanger described in any one of par. 15) to 20).

24) A vehicle having installed therein a refrigeration cycle described in par. 23) as an air conditioner.

In assembling the components for the fabrication of the heat exchanger described in par. 1), the position of the refrigerant passing hole in the flow dividing resistance plate can be discriminated from outside the header with reference to the identification mark. This reliably eliminates the likelihood that the header will be assembled as oriented in the opposite direction into the heat exchanger, consequently enabling the resistance plate to function to uniformalize the quantities of refrigerant to be passed through all the heat exchange tubes and permitting the exchanger to exhibit outstanding heat exchange performance.

With the heat exchangers described in par. 2) and 3), even in the case where the resistance plate has a plurality of refrigerant passing holes which are different in shape and/or size, it is possible to reliably obviate the likelihood that the header will be assembled as oriented in the opposite direction into the exchanger in assembling the components.

With the evaporators described in par. 4) and 5), the identification mark can be provided on the header outer surface relatively easily.

In assembling the components for the fabrication of the heat exchanger described in par. 6), the position of the refrigerant passing hole in the flow dividing resistance plate can be discriminated from outside the refrigerant outlet header with reference to the identification mark. This reliably eliminates the likelihood that the header will be assembled as oriented in the opposite direction into the heat exchanger, consequently enabling the resistance plate to function to uniformalize the quantities of refrigerant to be passed through all the heat exchange tubes and permitting the exchanger to exhibit outstanding heat exchange performance.

The heat exchanger described in par. 7) can be fabricated in its entirely from a reduced number of components.

With the heat exchanger described in par. 8, the partition wall and the resistance plate are integral with the second member and can therefore be provided inside the header tank by facilitated work.

With the process described in par. 9) for fabricating a heat exchanger, the press work for the second member provides the identification mark on the outer surface of the second member simultaneously when the refrigerant passing hole is made in the resistance plate, so that when recognized, the identification mark indicates that the hole is reliably formed.

In fabricating a heat exchanger using the header tank described in par. 12), the contour of the header tank indicates the proper longitudinal orientation of the header tank, reliably obviating the likelihood that the header tank will be assembled into the exchanger, as oriented in the opposite direction. Accordingly, when the header tank is provided inside thereof with means for improving the performance of the heat exchanger, the means can be positioned accurately as determined, consequently giving improved heat exchange performance to the exchanger having the header tank incorporated therein. When the header tank, as held by a jig having a recessed portion for an outer portion of the tank to fit in, is to be assembled into a heat exchanger, the header tank, if oriented in the opposite direction, will not fit into the recessed portion of the jig. This automatically indicates whether the header tank is oriented in the opposite direction.

In the case of the heat exchanger header tanks described in par. 13) and 14), the front and rear portions of the header tank can be made asymmetric in cross sectional contour relatively easily.

In fabricating the heat exchangers described in par. 15) and 18), the contour of the header tank indicates the proper longitudinal orientation of the header tank, reliably obviating the likelihood that the header tank will be assembled into the exchanger, as oriented in the opposite direction. Accordingly, when the header tank is provided inside thereof with means for improving the performance of the heat exchanger, the means can be positioned accurately as determined, consequently giving improved heat exchange performance to the exchanger having the header tank incorporated therein. When the header tank, as held by a jig having a recessed portion for an outer portion of the tank to fit in, is to be assembled into a heat exchanger, the header tank, if oriented in the opposite direction, will not fit into the recessed portion of the jig. This automatically indicates whether the header tank is oriented in the opposite direction.

In the case of the heat exchangers described in par. 16) and 17), the front and rear portions of the header tank can be made asymmetric in cross sectional contour relatively easily.

With the heat exchanger described in par. 20), the orientation of the first header tank can be accurately so determined as to position the inlet header on the front side and the outlet header provided with the resistance plate on the rear side. This enables the resistance plate to function to uniformalize the quantities of refrigerant to be passed through all the heat exchange tubes to ensure high heat exchange performance, further rendering the exchanger reduced in the number of components.

In the case where the header tanks as held by the jig and the heat exchange tubes are assembled by the processes described in par. 21) and 22) for fabricating a heat exchanger, at least the header tank having the ridge will not fit into the recessed portion if oriented in the opposite direction. This automatically indicates whether the header tank is oriented in the opposite direction.

BEST MODE OF CARRYING OUT THE INVENTION

Figure 1:
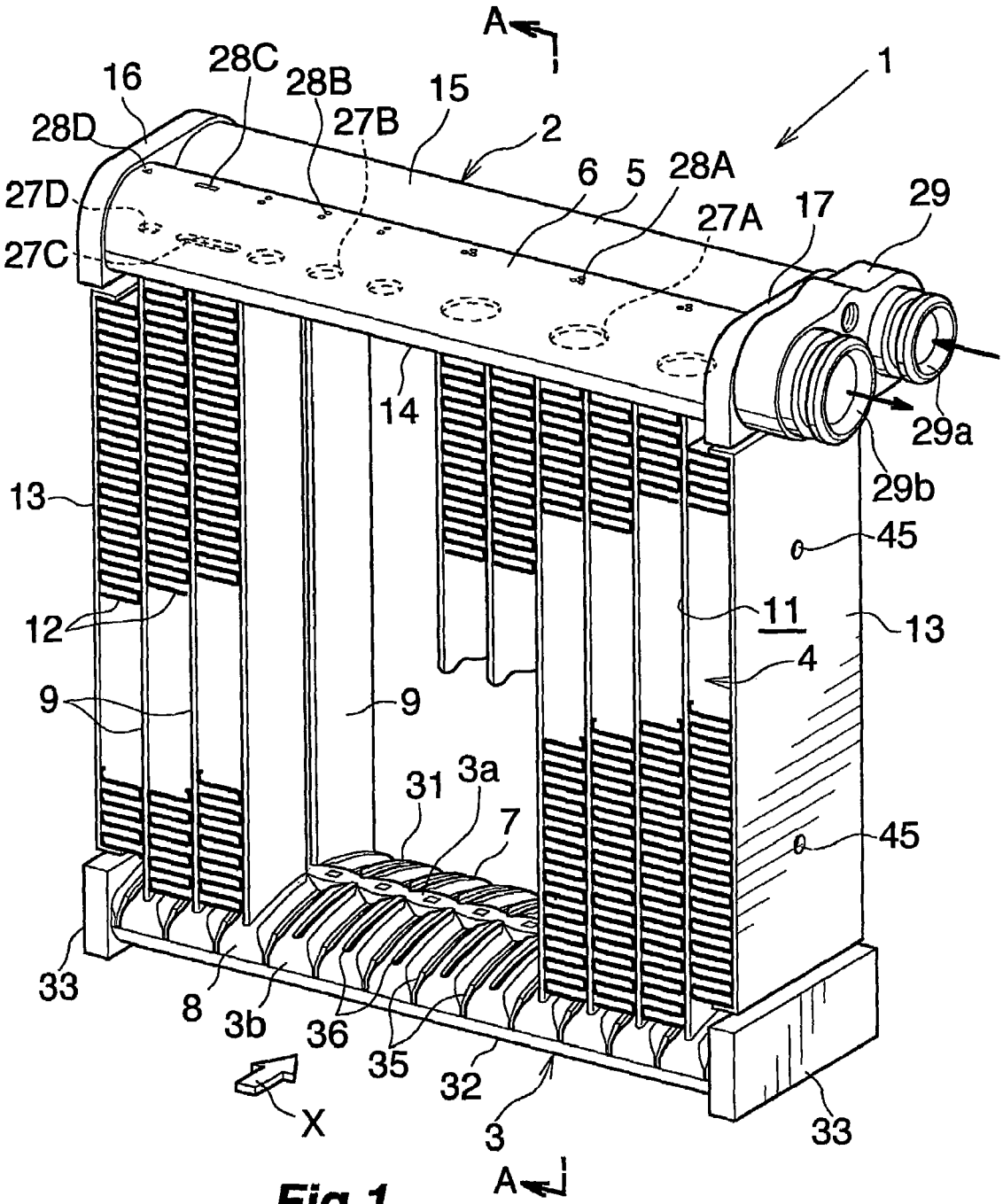
FIG. 1 is a perspective view partly broken away and showing the overall construction of a first embodiment of evaporator according to the invention.

Embodiments of the present invention will be described below with reference to the drawings. These embodiments are evaporators according to the invention.

In the following description, the upper, lower, left- and right-hand sides of FIGS. 1 and 10 will be referred to respectively as "upper," "lower, "left" and "right." Further in the following description, the term "aluminum" includes aluminum alloys in addition to pure aluminum.

Throughout the drawings, like parts will be designated by like reference numerals and will not be described repeatedly.

Figure 2:
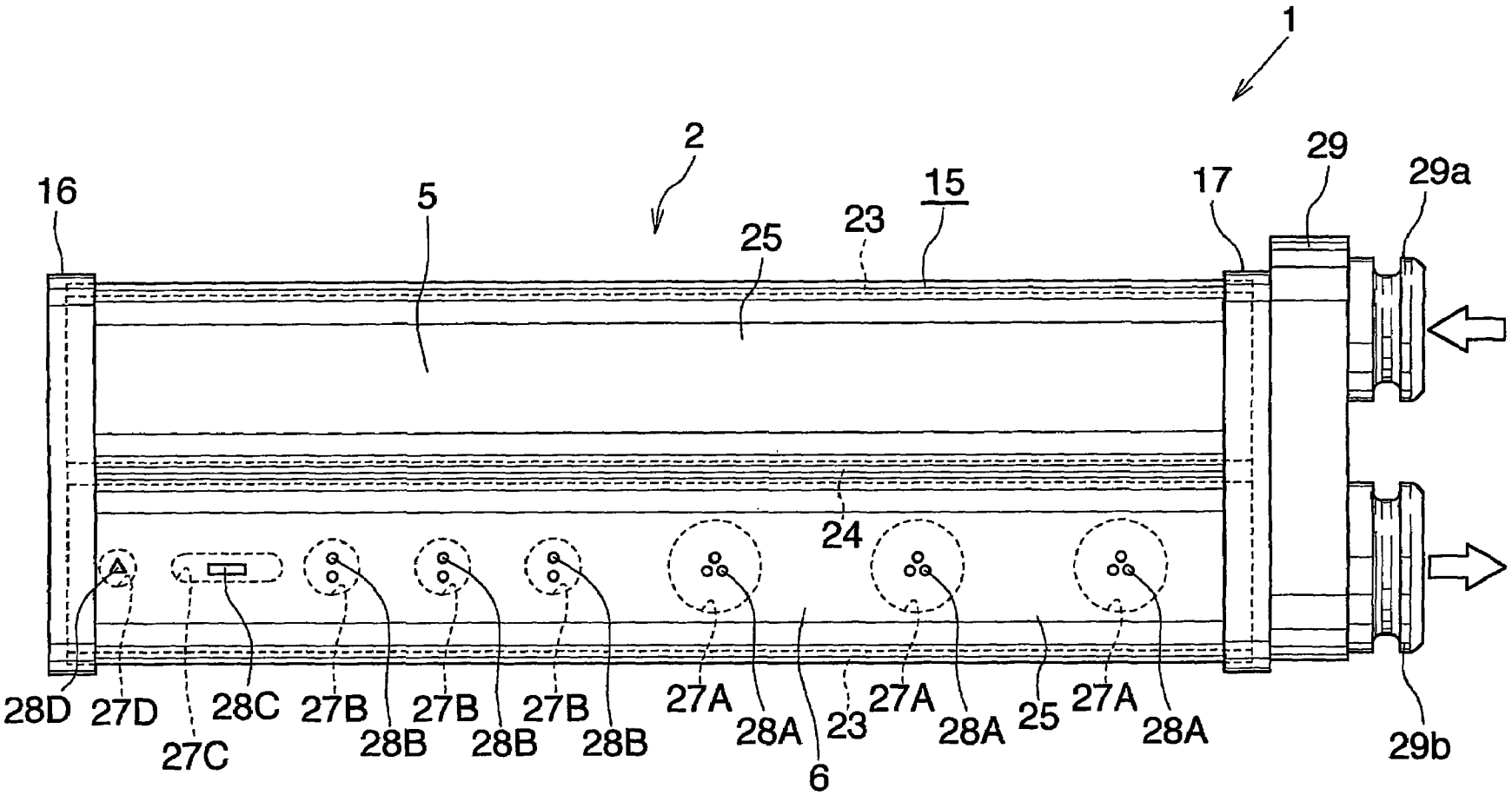
FIG. 2 is a plan view of the evaporator shown in FIG. 1.
Figure 3:
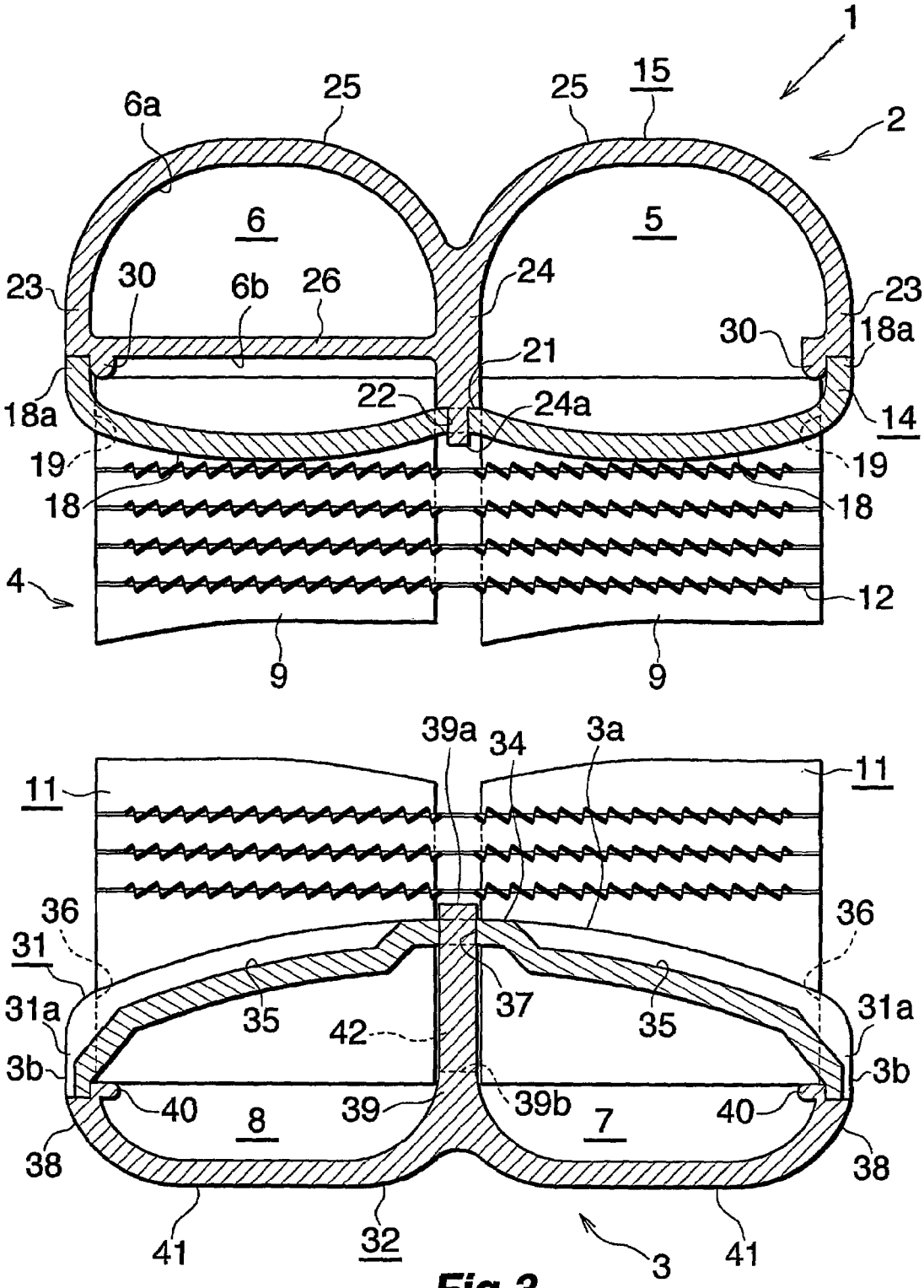
FIG. 3 is an enlarged view in section taken along the line A-A in FIG. 1 and partly broken away.
Figure 8:
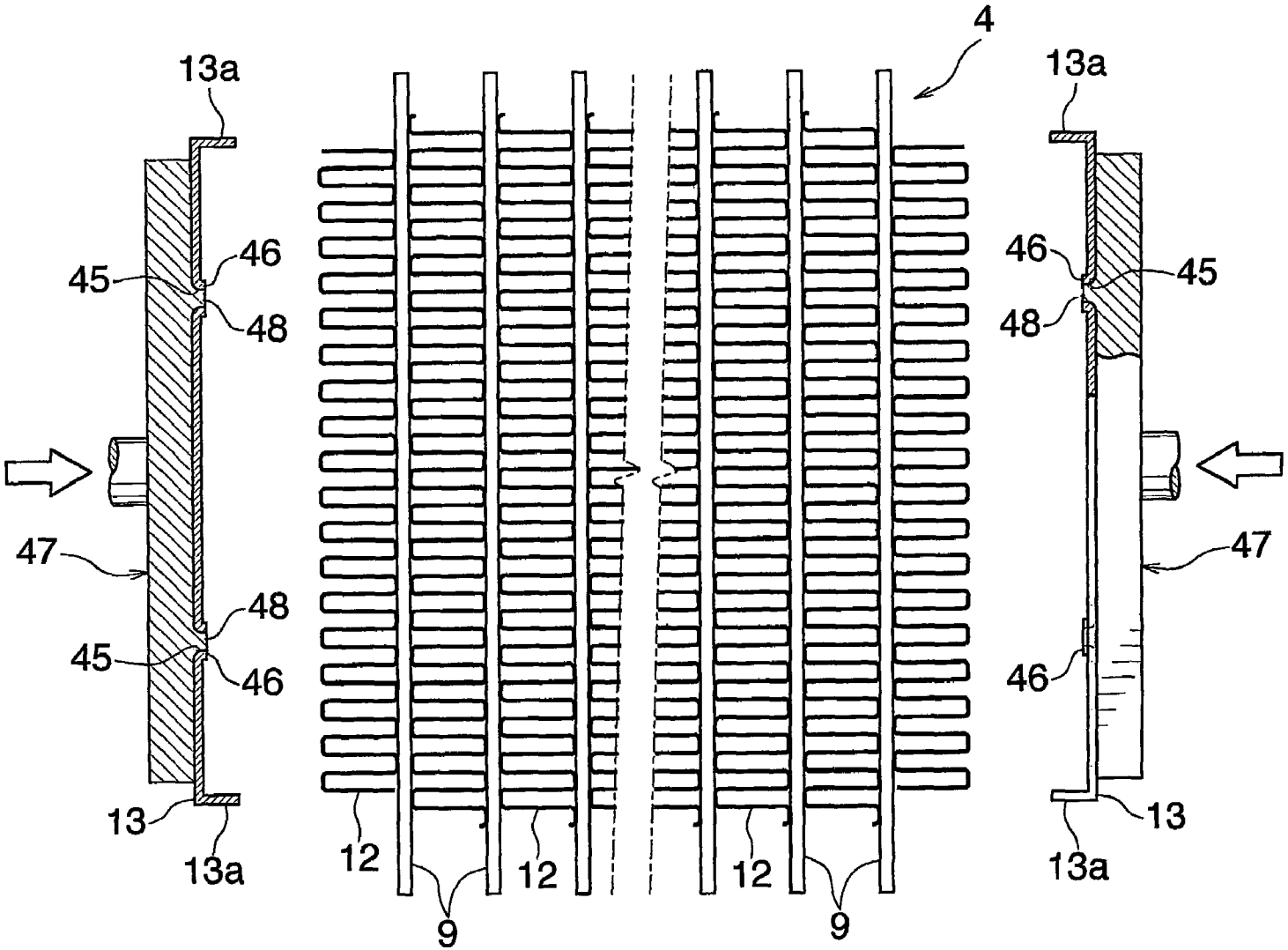
FIG. 8 is a diagram showing how to assemble heat exchange tubes, fins and side plates in fabricating the evaporator shown in FIG. 1.
Figure 9:
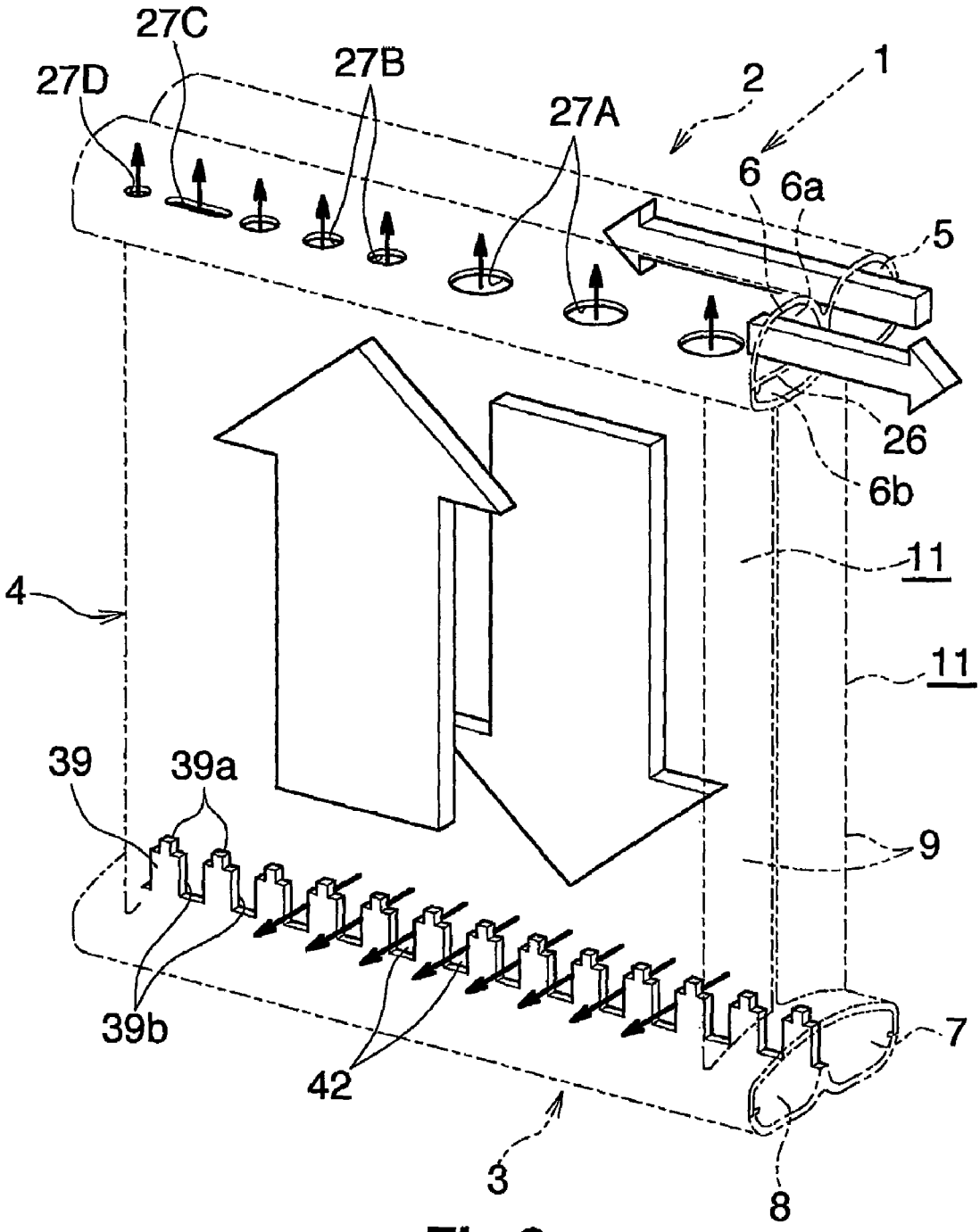
FIG. 9 is a diagram showing how a refrigerant flows through the evaporator shown in FIG. 1.

FIGS. 1 to 3 show the overall construction of a first embodiment of evaporator according to the invention, and FIGS. 4 to 7 show the constructions of main parts. FIG. 8 shows a method of assembling heat exchange tubes, fins and side plates in fabricating the evaporator, and FIG. 9 shows the flow of a refrigerant through the evaporator.

FIG. 1 shows an evaporator 1 which comprises a refrigerant inlet-outlet header tank 2 of aluminum and a refrigerant turn header tank 3 of aluminum which are arranged as vertically spaced apart, and a heat exchange core 4 provided between the two header tanks 2, 3.

The refrigerant inlet-outlet header tank 2 comprises a refrigerant inlet header 5 positioned on the front side (downstream side with respect to the flow of air through the evaporator) and a refrigerant outlet header 6 positioned on the rear side (upstream side with respect to the flow of air). The refrigerant turn header tank 3 comprises a refrigerant inflow header 7 as an intermediate header positioned on the front side and a refrigerant outflow header 8 as an intermediate header positioned on the rear side.

The heat exchange core 4 comprises tube groups 11 in the form of a plurality of rows, i.e., two rows in the present embodiment, as arranged forward or rearward, each tube group 11 comprising a plurality of heat exchange tubes 9 of aluminum arranged in parallel leftward or rightward, i.e., laterally of the evaporator, at a spacing. Corrugated aluminum fins 12 are arranged respectively in air passing clearances between respective adjacent pairs of heat exchange tubes 9 of each tube group 11 and also outside the heat exchange tubes 9 at the left and right opposite ends of each tube group 11, and are each brazed to the heat exchange tube 9 adjacent thereto. An aluminum side plate 13 is disposed outside the corrugated fin 12 at each of the left and right ends and brazed to the fin 12. The heat exchange tubes 9 of the front tube group 11 have upper and lower ends joined respectively to the inlet header 5 and the inflow header 7, and the heat exchange tubes 9 of the rear tube group 11 have upper and lower ends joined respectively to the outlet header 6 and the outflow header 8.

Figure 4:
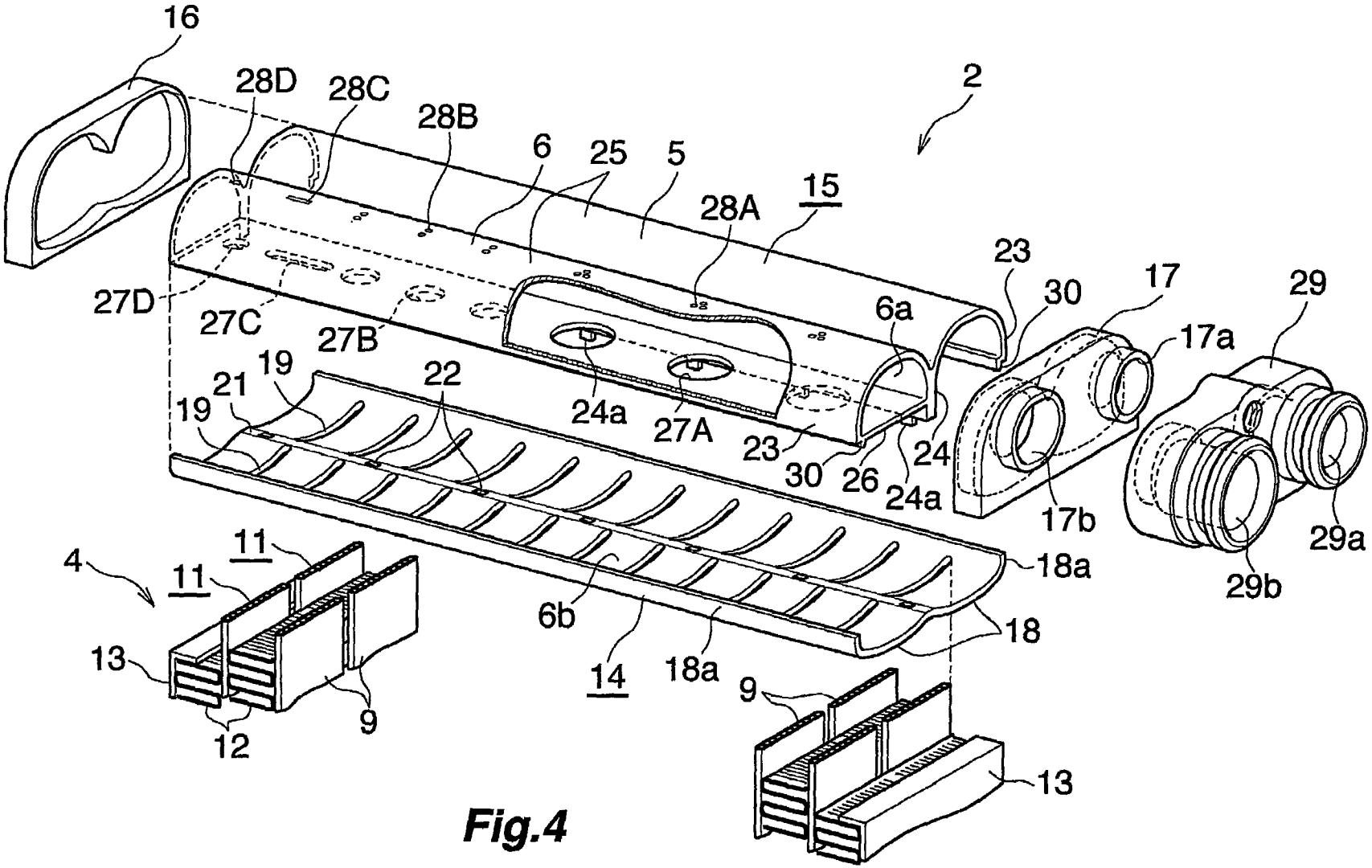
FIG. 4 is an exploded perspective view of a refrigerant inlet-outlet tank of the evaporator shown in FIG. 1.

With reference to FIGS. 2 to 4, the refrigerant inlet-outlet tank 2 comprises a platelike first member 14 made of an aluminum brazing sheet having a brazing material layer at least over the outer surface (lower surface) thereof and having the heat exchange tubes 9 joined thereto, a second member 15 of bare aluminum extrudate and covering the upper side of the first member 14, and aluminum caps 16, 17 closing respective left and right end openings.

The first member 14 has at each of the front and rear side portions thereof a curved portion 18 in the form of a circular arc of small curvature in cross section and bulging downward at its midportion. The curved portion 18 has a plurality of tube insertion slits 19 elongated forward or rearward and arranged at a spacing in the lateral direction. Each corresponding pair of slits 19 in the front and rear curved portions 18 are in the same position with respect to the lateral direction. The front edge of the front curved portion 18 and the rear edge of the rear curved portion 18 are integrally provided with respective upstanding walls 18*a* extending over the entire length of the member 14. The first member 14 includes between the two curved portions 18 a flat portion 21 having a plurality of through holes 22 arranged at a spacing in the lateral direction.

The second member 15 is generally m-shaped in cross section and opened downward and comprises front and rear two walls 23 extending laterally, a partition wall 24 provided in the midportion between the two walls 23 and extending laterally to divide the interior of the refrigerant inlet-outlet tank 2 into front and rear two spaces, and two generally circular-arc connecting walls 25 bulging upward and integrally connecting the partition wall 24 to the respective front and rear walls 23 at their upper ends. The front and rear side edges of the second member 15, i.e., the lower edges of the front and rear walls 23, are integrally provided over the entire length of the member 15 with tube bearing ridges 30 projecting inwardly of the respective headers 5, 6 and also projecting toward the first member 14. The front upper portion of the rear projection 30 and the lower end of the partition wall 24 are interconnected by a flow dividing resistance plate 26 over the entire length. A plate separate from the projection 30 and the partition wall 24 may alternatively be fixed to the projection 30 and the wall 24 as the resistance plate 26.

The flow dividing resistance plate 26 has a plurality of refrigerant passing holes 27A, 27B, 27C, 27D different in shape and/or size and arranged at a spacing laterally of the plate 26. The plate 26 of the illustrated embodiment has a plurality of, i.e., three, first refrigerant passing holes 27A which are identical in shape and size, a plurality of, i.e., three, second refrigerant passing holes 27B which are identical with the first holes 27A in shape and different therefrom in size, a third refrigerant passing hole 27C different from the holes 27A, 27B in shape and size, and a fourth refrigerant passing hole 27D identical with the first and second holes 27A, 27B in shape and different therefrom in size. The connecting wall 25 of the second member 15 is provided on the outer surface thereof with identification marks 28A, 28B, 28C, 28D positioned in corresponding relation with the respective refrigerant passing holes 27A, 27B, 27C, 27D for discriminating these holes 27A, 27B, 28C, 27D. The identification marks 28A, 28B, 28C, 28D are different in accordance with the shapes and/or sizes of the refrigerant passing holes 27A, 27B, 27C, 27D. Thus, the identification marks 28A, 28B, 28C, 28D for the first to fourth refrigerant passing holes 27A, 27B, 27C, 27D are different, and moreover, the same identification marks 28A or 28B are provided respectively for the holes 27A or 27B which are identical in shape and size. Accordingly, the marks 28A, 28B, 28C, 28D represent the shapes and/or sizes of the holes 27A, 27B, 27C, 27D in addition to the positions thereof. The identification marks 28A, 28B, 28C, 28D comprise, for example, indentations or projections or a combination of such portions, provided on the outer surface of the connecting wall. The marks 28A, 28B, 28C, 28D are not limited to those illustrated but can be modified or changed suitably.

The partition wall 24 has a lower end projecting downward beyond the lower ends of the tube bearing ridges 30 of the front and rear walls 23 and is integrally provided with a plurality of projections 24*a* projecting downward from the lower edge of the wall 24, arranged at a spacing in the lateral direction and fitted into the through holes 22 of the first member 14. The projections 24*a* are formed by cutting away specified portions of the partition wall 24.

The second member 15 is produced by extruding the front and rear walls 23, partition wall 24, connecting walls 25, tube bearing ridges 30 and flow dividing resistance plate 26 in the form of an integral piece, thereafter subjecting the extrudate to press work to form the refrigerant passing holes 27A, 27B, 27C, 27D in the resistance plate 26 and to provide the identification marks 28A, 28B, 28C, 28D at the same time, and further cutting away portions of the partition walls 24 to form the projections 24*a*.

The caps 16, 17 are made from a bare material as by press work, forging or cutting, each have a recess facing laterally inward for the corresponding ends of the first and second members 14, 15 to fit in. The right cap 17 has a refrigerant inflow opening 17*a* in communication with the refrigerant inlet header 5, and a refrigerant outflow opening 17*b* communicating with the upper portion of the refrigerant outlet header 6 above the resistance plate 26. Brazed to the right cap 17 is a refrigerant inlet-outlet aluminum member 29 having a refrigerant inlet 29*a* communicating with the refrigerant inflow opening 17*a* and a refrigerant outlet 29*b* communicating with the refrigerant outflow opening 17*b*.

The two members 14, 15 are brazed to each other utilizing the brazing material layer of the first member 14, with the projections 24*a* of the second member 15 inserted in the respective holes 22 of the first member 15 in crimping engagement, with the upper end faces of the front and rear upstanding walls 18*a* of the first member 14 in contact with the lower end faces of the front and rear walls 23 of the second member 15, and with the inner faces of the front and rear upstanding walls 18*a* in contact with the outer faces of the front and rear tube bearing ridges 30. The two caps 16, 17 are further brazed to the first and second members 14, 15 using a brazing material sheet. Thus, the inlet-outlet tank 2 is made. The portion of the tank 2 forwardly of the partition wall 24 of the second member 15 serves as the refrigerant inlet header 5, and the portion thereof rearwardly of the partition wall 24 as the refrigerant outlet header 6. Furthermore, the refrigerant outlet header 6 is divided into upper and lower two spaces 6*a*, 6*b* by the flow dividing resistance plate 26, and these spaces 6*a*, 6*b* are in communication through the refrigerant passing holes 27A, 27B, 27C, 27D. The lower space 6*b* is a first space in communication with the heat exchange tubes 9 of the rear tube group 11, and the upper space 6*a* a second space via which the refrigerant flows out of the evaporator. The refrigerant outflow opening 17*b* of the right cap 17 is in communication with the upper space 6*a* of the refrigerant outlet header 6.

Figure 5:
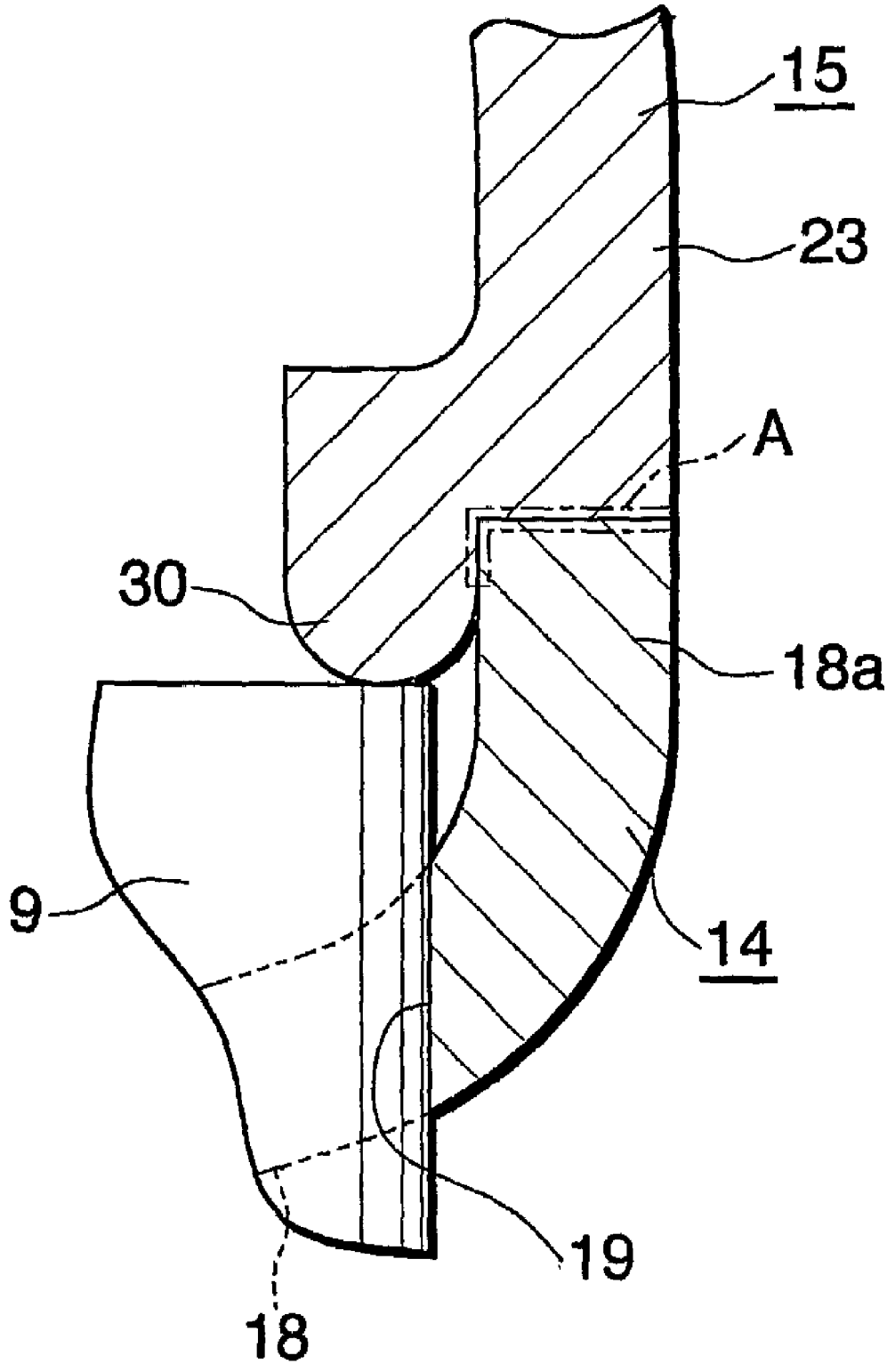
FIG. 5 is a sectional view showing on an enlarged scale a joint between a first member and a second member of the inlet-outlet tank shown in FIG. 1.

With reference to FIG. 5, the front or rear side edge of the first member 14, i.e., the upper edge of the front or rear upstanding wall 18*a*, and the front or rear side edge of the second member 15, i.e., the lower edge of the front or rear wall 23, have a brazed joint. In cross section, the length of the joint is the thickness of the upstanding wall 18*a* and the front or rear wall 23 plus the length of contact between the rear face of the upstanding wall 18*a* and the tube bearing ridge 30, as indicated by being surrounded with a chain line A in FIG. 5. The length of the brazed joint is preferably at least 1.2 times, more preferably at least twice, the thickness of the first member upstanding wall 18*a* and the thin portion of the second member front or rear wall 23. The brazed joint of the first member 14 and the second member 15 then has an enhanced strength against a break or leakage. In the illustrated embodiment, the upstanding wall 18*a* of the first member 14 and the front or rear wall 23 of the second member 15 are equal in wall thickness.

Figure 6:
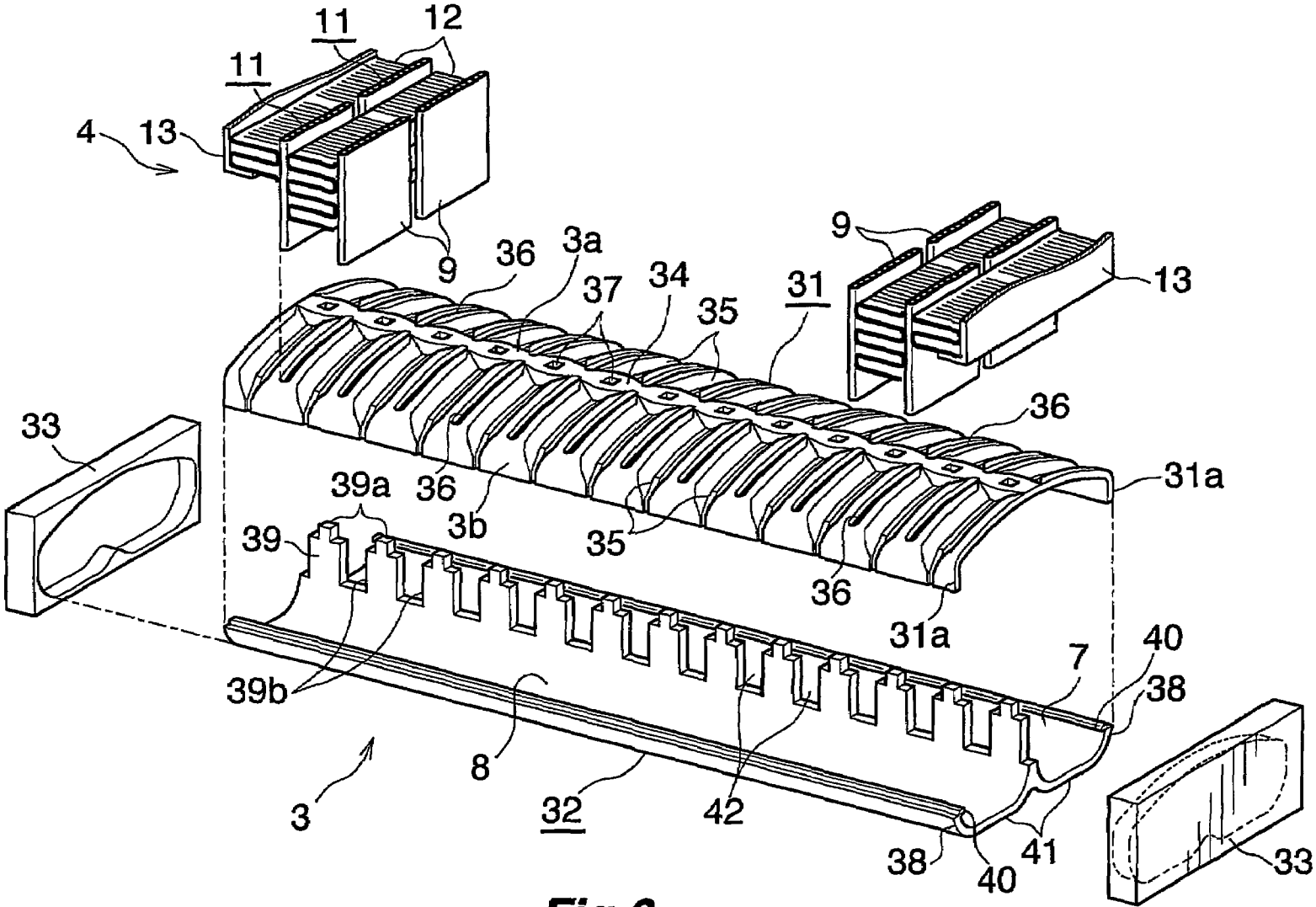
FIG. 6 is an exploded perspective view of a refrigerant turn tank of the evaporator shown in FIG. 1.

With reference to FIGS. 3 and 6, the refrigerant turn tank 3 comprises a platelike first member 31 made of aluminum brazing sheet having a brazing material layer at least over the outer surface (upper surface) thereof and having the heat exchange tubes 4 joined thereto, a second member 32 made of bare aluminum extrudate and covering the lower side of the first member 31, and aluminum caps 33 for closing left and right opposite end openings.

The refrigerant turn tank 3 has a top surface 3*a* which is in the form of a circular-arc in cross section in its entirety such that the midportion thereof with respect to the forward or rearward direction is the highest portion 34 which is gradually lowered toward the front and rear sides. The tank 3 is provided in its front and rear opposite side portions with grooves 35 extending from the front and rear opposite sides of the highest portion 34 of the top surface 3*a* to front and rear opposite side surfaces 3*b*, respectively, and arranged laterally at a spacing.

The first member 31 has a circular-arc cross section bulging upward at its midportion with respect to the forward or rearward direction and is provided with a depending wall 31*a* formed at each of the front and rear side edges thereof integrally therewith and extending over the entire length of the member 31. The upper surface of the first member 31 serves as the top surface 3*a* of the refrigerant turn tank 3, and the outer surface of the depending wall 31*a* as the front or rear side surface 3*b* of the tank 3. The grooves 35 are formed in each of the front and rear side portions of the first member 31 and extend from the highest portion 34 in the midportion of the member 31 with respect to the forward or rearward direction to the lower end of the depending wall 31*a*. In each of the front and rear side portions of the first member 31 other than the highest portion 34 in the midportion thereof, tube insertion slits 36 elongated in the forward or rearward direction are formed between respective adjacent pairs of grooves 35. Each corresponding pair of front and rear tube insertion slits 36 are in the same position with respect to the lateral direction. The first member 31 has a plurality of through holes 37 formed in the highest portion 34 in the midportion thereof and arranged laterally at a spacing. The depending walls 31*a*, grooves 35, tube insertions slits 36 and through holes 37 of the first member 31 are formed at the same time by making the member 31 from an aluminum brazing sheet by press work.

The second member 32 is generally w-shaped in cross section and opened upward, and comprises front and rear two walls 38 curved upwardly outwardly forward and rearward, respectively, and extending laterally, a vertical partition wall 39 provided at the midportion between the two walls 38, extending laterally and dividing the interior of the refrigerant turn tank 3 into front and rear two spaces, and two connecting walls 41 integrally connecting the partition wall 39 to the respective front and rear walls 38 at their lower ends. The front and rear opposite side edges of the second member 32, i.e., the upper edges of the front and rear walls 38, are integrally provided with tube bearing ridges 40 projecting into the respective headers 7, 8 and extending over the entire length of the member 32.

The partition wall 39 has an upper end projecting upward beyond the upper ends of the front and rear walls 38, and is provided with a plurality of projections 39*a* projecting upward from the upper edge of the wall 39 integrally therewith, arranged laterally at a spacing and fitted into the respective through holes 37 in the first member 31. The partition wall 39 is provided with refrigerant passing cutouts 39*b* formed in the upper edge thereof between respective adjacent pairs of projections 39*a*. The projections 39*a* and the cutouts 39*b* are formed by cutting away specified portions of the partition wall 39.

The second member 32 is produced by extruding the front and rear walls 38, partition wall 39, connecting walls 41 and tube bearing ridges 40 in the form of an integral member, and cutting the partition wall 39 to form the projections 39*a* and cutouts 39*b*.

The caps 33 are made from a bare material as by press work, forging or cutting, and each have a recess facing laterally inward for the corresponding ends of the first and second members 31, 32 to fit in.

The first and second members 31, 32 are brazed to each other utilizing the brazing material layer of the first member 31, with the projections 39*a* of the second member 32 inserted through the respective holes 37 in crimping engagement, with the lower end faces of the depending walls 31*a* of the first member 31 bearing on the upper end faces of the front and rear walls 38 of the second member 32, and with the inner faces of the front and rear depending walls 31*a* in contact with the outer faces of the tube bearing ridges 40. The two caps 33 are further brazed to the first and second members 31, 32 using a brazing material sheet. In this way, the refrigerant turn tank 3 is formed. The portion of the second member 32 forwardly of the partition wall 39 serves as the inflow header 7, and the portion thereof rearwardly of the partition wall 39 as the outflow header 8. The upper-end openings of the cutouts 39*b* in the partition wall 39 of the second member 32 are closed with the first member 31, whereby refrigerant passing holes 42 are formed. The refrigerant passing holes 42, which are formed by closing the upper-end openings of the cutouts 39*b* in the partition wall 39 with the first member 31, can alternatively be through holes formed in the partition wall 39.

The tube bearing ridges 30 or 40 of the refrigerant inlet-outlet header tank 2 or the refrigerant turn header tank 3, although provided on the front and rear walls 23 or 38 of the second member 15 or 32, may alternatively be provided on the partition wall 24 or 39 of the second member 15 or 32.

In the turn header tank 3 described, the front or rear side edge of the first member 31, i.e., the lower edge of the front or rear depending wall 31*a*, and the front or rear side edge of the second member 32, i.e., the upper edge of the front or rear wall 38, have a brazed joint. In cross section, the length of the brazed joint is preferably at least 1.2 times the smaller of the thickness of the depending wall 31*a* of the first member and the thickness of the front or rear wall 38, that is, at least 1.2 times, more preferably at least twice, the thickness of the depending wall 31*a*, as in the case of the inlet-outlet header tank 2. The brazed joint of the first member 31 and the second member 32 then has an enhanced strength against a break or leakage.

The heat exchange tubes 9 providing the front and rear tube groups 11 are each made of a bare material in the form of an aluminum extrudate. Each tube 9 is flat, has a large width in the forward or rearward direction and is provided in its interior with a plurality of refrigerant channels extending longitudinally of the tube and arranged in parallel. The tube 9 has front and rear opposite end walls which are each in the form of an outwardly bulging circular arc. Each corresponding pair of heat exchange tube 9 of the front tube group 11 and heat exchange tube 9 of the rear tube group 11 are in the same position with respect to the lateral direction, have their upper ends placed into aligned tube insertion slits 19 in the first member 14 of the refrigerant inlet-outlet header tank 2 and are brazed to the first member 14 utilizing the brazing material layer of the first member 14, with the tube upper ends in contact with the respective tube bearing ridges 30. These tubes 9 have their lower ends placed into aligned tube insertion slits 36 in the first member 31 of the refrigerant turn header tank 3 and are brazed to the first member 31 utilizing the brazing material layer of the first member 31, with the tube lower ends in contact with the respective tube bearing ridges 40. The heat exchange tubes 9 of the front tube group 11 are in communication with the refrigerant inlet header 5 and the refrigerant inflow header 7, and the heat exchange tubes 9 of the rear tube group 11 are in communication with the refrigerant outlet header 6 and the refrigerant outflow header 8.

The length of projection of the upper end of the heat exchange tube 9 into the inlet header 5, as well as into the outlet header 6, is preferably at least 1 mm at the smallest end portion projecting into the header, i.e., at the front or rear side edge. The length of projection of the lower tube end into the inflow header 7, as well as into the outflow header 8, is preferably at least 1 mm at the smallest end portion projecting into the header, i.e., at the forwardly or rearwardly outer side edge. When the tube 9 is brazed to the first members 14, 31, this prevents the refrigerant channels of the tube 9 from becoming clogged up with the brazing material, consequently eliminating an increase in pressure loss and impairment of refrigeration performance. The straight distance from the upper end face of the tube 9 to the portion of inner peripheral surface of the inlet header 5 which portion is remotest from the tube upper end face, as well as to like portion of the outlet header 6, i.e., to the inner surface of the upper end of the connecting wall 25, and the straight distance from the lower end face of the tube 9 to the portion of inner peripheral surface of the inflow header 7 which portion is remotest from the tube lower end face, as well as to like portion of the outflow header 8, i.e., to the upper surface of the flat portion of the connecting wall 41, is preferably at least 3 mm. This prevents divided flows of the refrigerant into all the heat exchange tubes 9 from becoming uneven and precludes an increase in pressure loss, consequently obviating the impairment of refrigeration performance.

Preferably, the heat exchange tube 9 is 0.75 to 1.5 mm in height, i.e., in thickness in the lateral direction, 12 to 18 mm in width in the forward or rearward direction, 0.175 to 0.275 mm in the wall thickness of the peripheral wall thereof, 0.175 to 0.275 mm in the thickness of partition walls separating refrigerant channels from one another, 0.5 to 3.0 mm in the pitch of partition walls, and 0.35 to 0.75 mm in the radius of curvature of the outer surfaces of the front and rear opposite end walls.

In place of the heat exchange tube 9 of aluminum extrudate, an electric resistance welded tube of aluminum may be used which has a plurality of refrigerant channels formed therein by inserting inner fins into the tube. Also usable is a tube which is made from a plate prepared from an aluminum brazing sheet having an aluminum brazing material layer on opposite sides thereof by rolling work and which comprises two flat wall forming portions joined by a connecting portion, a side wall forming portion formed on each flat wall forming portion integrally therewith and projecting from one side edge thereof opposite to the connecting portion, and a plurality of partition forming portions projecting from each flat wall forming portion integrally therewith and arranged at a spacing widthwise thereof, by bending the plate into the shape of a hairpin at the connecting portion and brazing the side wall forming portions to each other in butting relation to form partition walls by the partition forming portions. The corrugated fins to be used in this case are those made from a bare material.

The corrugated fin 12 is made from an aluminum brazing sheet having a brazing material layer on opposite sides thereof by shaping the sheet into a wavy form. Louvers are formed as arranged in parallel in the forward or rearward direction in the portions of the wavy sheet which connect crest portions thereof to furrow portions thereof. The corrugated fins 12 are used in common for the front and rear tube groups 11. The width of the fin 12 in the forward or rearward direction is approximately equal to the distance from the front edge of the heat exchange tube 9 in the front tube group 11 to the rear edge of the corresponding heat exchange tube 9 in the rear tube group 11. It is desired that the corrugated fin 12 be 7.0 mm to 10.0 mm in fin height, i.e., the straight distance from the crest portion to the furrow portion, and 1.3 to 1.8 mm in fin pitch, i.e., the pitch of connecting portions. Instead of one corrugated fin serving for both the front and rear tube groups 11 in common, a corrugated fin may be provided between each adjacent pair of heat exchange tubes 9 of each tube group 11.

Figure 7:
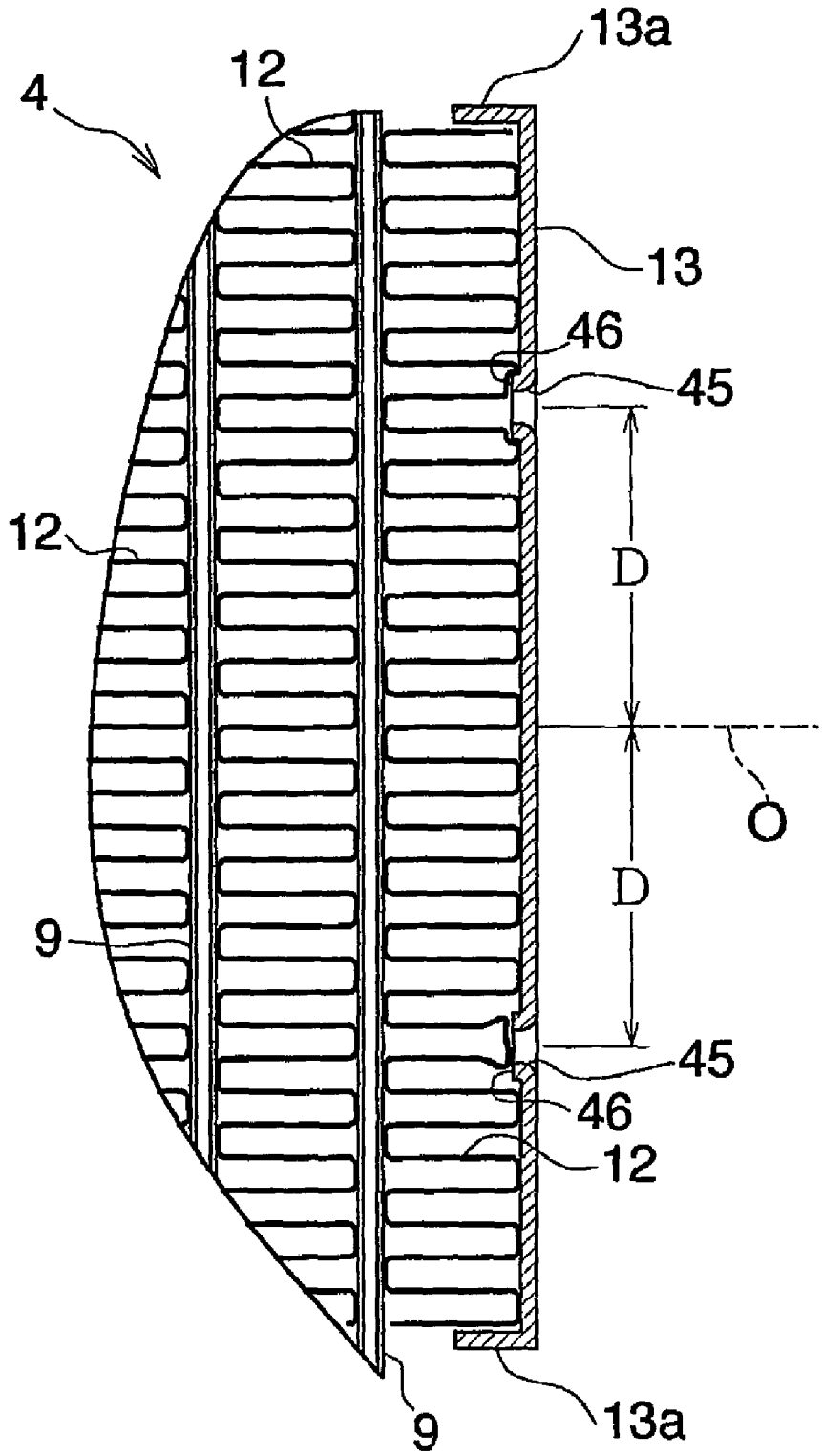
FIG. 7 is a view in vertical section showing on an enlarged scale a side plate portion of the evaporator shown in FIG. 1.

With reference to FIG. 7, each side plate 13 is made from a bare aluminum material and has a bent portion 13*a* projecting laterally inward at each of its upper and lower opposite ends. The side plate 13 has a forward or rearward width equal to the forward or rearward width of the corrugated fin 12. The side plate 13 has a plurality of, i.e., two, positioning circular through holes 45 positioned on the center line of the plate with respect to the widthwise direction at a location closer to one end (upper end) of the plate and at a location closer to the other end (lower end) thereof, respectively, than the center of the plate with respect to the lengthwise direction. The positioning hole 45 is not limited to the circular shape but may be elliptical. The distance D from the center O of the side plate 13 with respect to the lengthwise direction to the center of each positioning through hole 45 is preferably 30 to 90 mm, more preferably 40 to 70 mm. The distances from the center O of the side plate 13 to the respective positioning through holes 45 are preferably equal. An upright portion 46 for preventing the fin from slipping off is provided on one side (laterally inner side) of the plate 13 facing the fin 12 around the inner peripheral edge of the plate defining each positioning hole 45 integrally therewith. The upright portion 46 is formed by burring the side plate. The height of projection of the upright portion 46 is preferably up to 2 mm. more preferably up to about 0.5 mm. The corrugated fin 12 can then be prevented from deforming to the greatest possible extent.

The side plate 13 described above is provided with two positioning through holes 45 on the center line of the plate with respect to the widthwise direction at a location closer to one end (upper end) of the plate and at a location closer to the other end (lower end) thereof, respectively, than the center of the plate with respect to the lengthwise direction, whereas this arrangement is not limitative; the positions of the holes 45 are suitable shiftable, while at least three positioning holes 45 may be provided. In the case where at least three holes 45 are to be provided, at least two positioning holes 45 are formed respectively at a location closer to one end (upper end) of the plate and at a location closer to the other end (lower end) thereof, than the center of the plate with respect to the lengthwise direction, with an upright portion 46 formed around each hole-defining peripheral edge of the plate.

The evaporator 1 is fabricated by tacking the components in combination and brazing the tacked assembly collectively.

For the fabrication of the evaporator, the heat exchange tubes 9, corrugated fins 12 and side plates 13 are assembled by the method shown in FIG. 8. A plurality of heat exchange tubes 9 and corrugated fins 12 are arranged alternately so as to position the fin 12 at each end of the arrangement. Movable jigs 47 are then prepared each of which has two projections 48 insertable into the respective positioning through holes 45. With the projections 48 inserted into the holes 45 in the side plates 13, the jigs 47 are moved toward the arrangement of tubes 9 and fins 12 to position the side plates 13 externally of the corrugated fins 12 at opposite ends.

Along with a compressor and a condenser, the evaporator 1 constitutes a refrigeration cycle, which is installed in vehicles, for example, in motor vehicles for use as an air conditioner.

With reference to FIG. 9 showing the evaporator 1 described, a two-layer refrigerant of vapor-liquid mixture phase flowing through a compressor, condenser and pressure reduction means enters the refrigerant inlet header 5 of the refrigerant inlet-outlet tank 2 via the refrigerant inlet 29*a* of the refrigerant inlet-outlet member 29 and the refrigerant inflow opening 17*a* of the right cap 17 and dividedly flows into the refrigerant channels of all the heat exchange tubes 9 of the front tube group 11.

The refrigerant flowing into the channels of all the heat exchange tubes 9 flows down the channels and ingresses into the refrigerant inflow header 7 of the refrigerant turn tank 3. The refrigerant in the header 7 flows through the refrigerant passing holes 42 of the partition wall 39 into refrigerant outflow header 8.

The refrigerant in the header 8 dividedly flows into the refrigerant channels of all the heat exchange tubes 9 of the rear tube group 11, changes its course and passes upward through the channels into the lower space 6*b* of the refrigerant outlet header 6 of the refrigerant inlet-outlet tank 2. The flow dividing resistance plate 26 provided in the outlet header 6 gives resistance to the flow of refrigerant, consequently enabling the refrigerant to flow as uniformly divided from the outflow header 8 into all heat exchange tubes 9 of the rear tube group 11 and also to flow from inlet header 5 into all the tubes 9 of the front tube group 11. As a result, the refrigerant flows through all the heat exchange tubes 9 of the two tube groups in uniform quantities.

Subsequently, the refrigerant flows through the refrigerant passing holes 27A, 27B, 27C, 27D of the resistance plate 26 into the upper space 6*a* of the outlet header 6 and flows out of the evaporator via the refrigerant outflow opening 17*b* of the cap 17 and the outlet 29*b* of the refrigerant inlet-outlet member 29. While flowing through the refrigerant channels of the heat exchange tubes 9 of the front tube group 11 and the refrigerant channels of the heat exchange tubes 9 of the rear tube group 11, the refrigerant is subjected to heat exchange with air flowing through the air passing clearances in the direction of arrow X shown in FIG. 1 and flows out of the evaporator in a vapor phase.

At this time, water condensate is produced on the surfaces of the corrugated fins 12, and the condensate flows down the top surface 3*a* of the turn tank 3. The condensate flowing down the tank top surface 3*a* enters the grooves 35 by virtue of a capillary effect, flows through the grooves 35 and falls off the forwardly or rearwardly outer ends of the grooves 35 to below the turn tank 3. This prevents a large quantity of condensate from collecting between the top surface 3*a* of the turn tank 3 and the lower ends of the corrugated fins 12, consequently preventing the condensate from freezing due to the collection of large quantity of the condensate, whereby inefficient performance of the evaporator 1 is precluded.

FIGS. 10 to 13 show a second embodiment of evaporator according to the invention.

Figure 10:
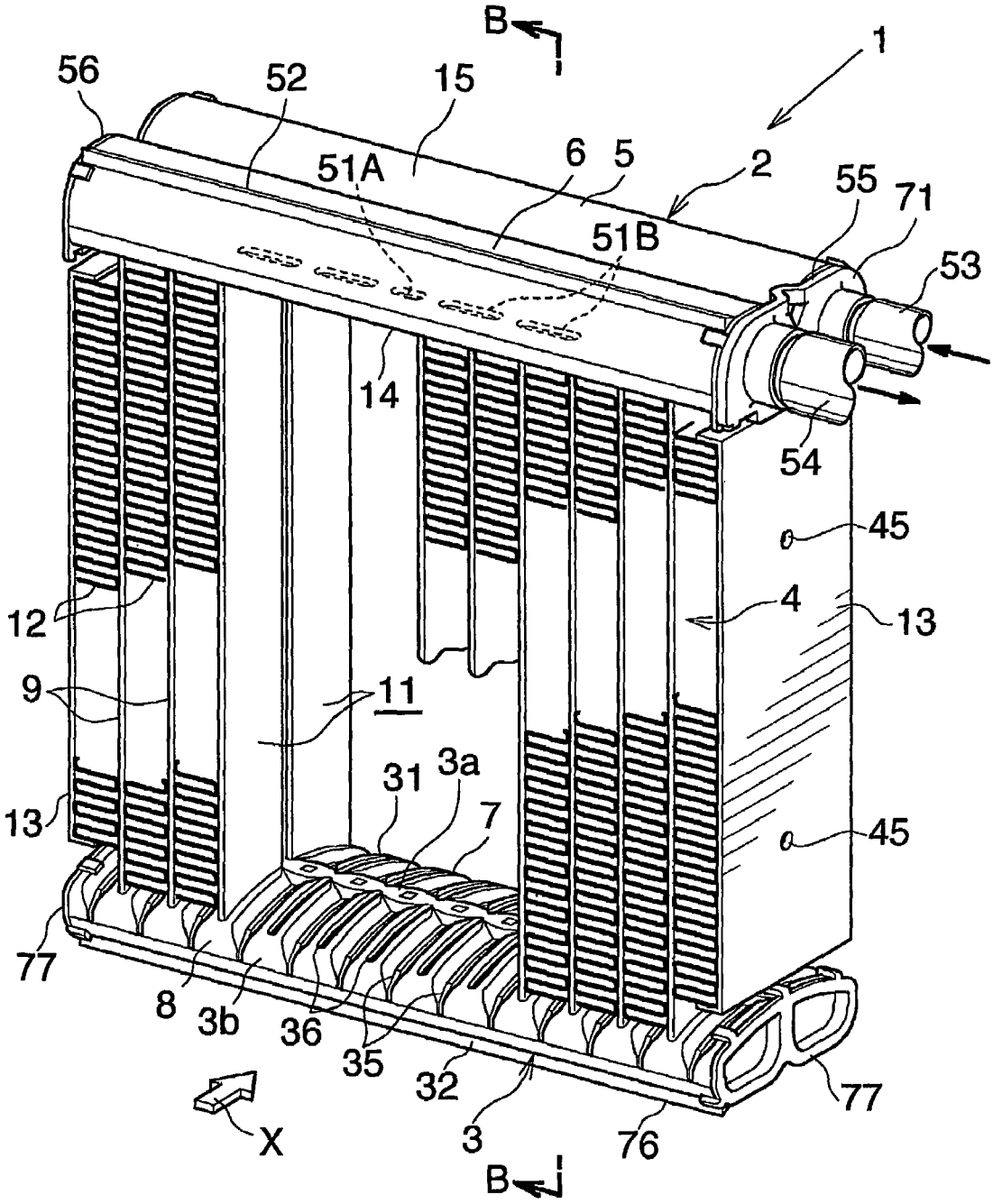
FIG. 10 is a perspective view partly broken away and showing the overall construction of a second embodiment of evaporator according to the invention.
Figure 11:
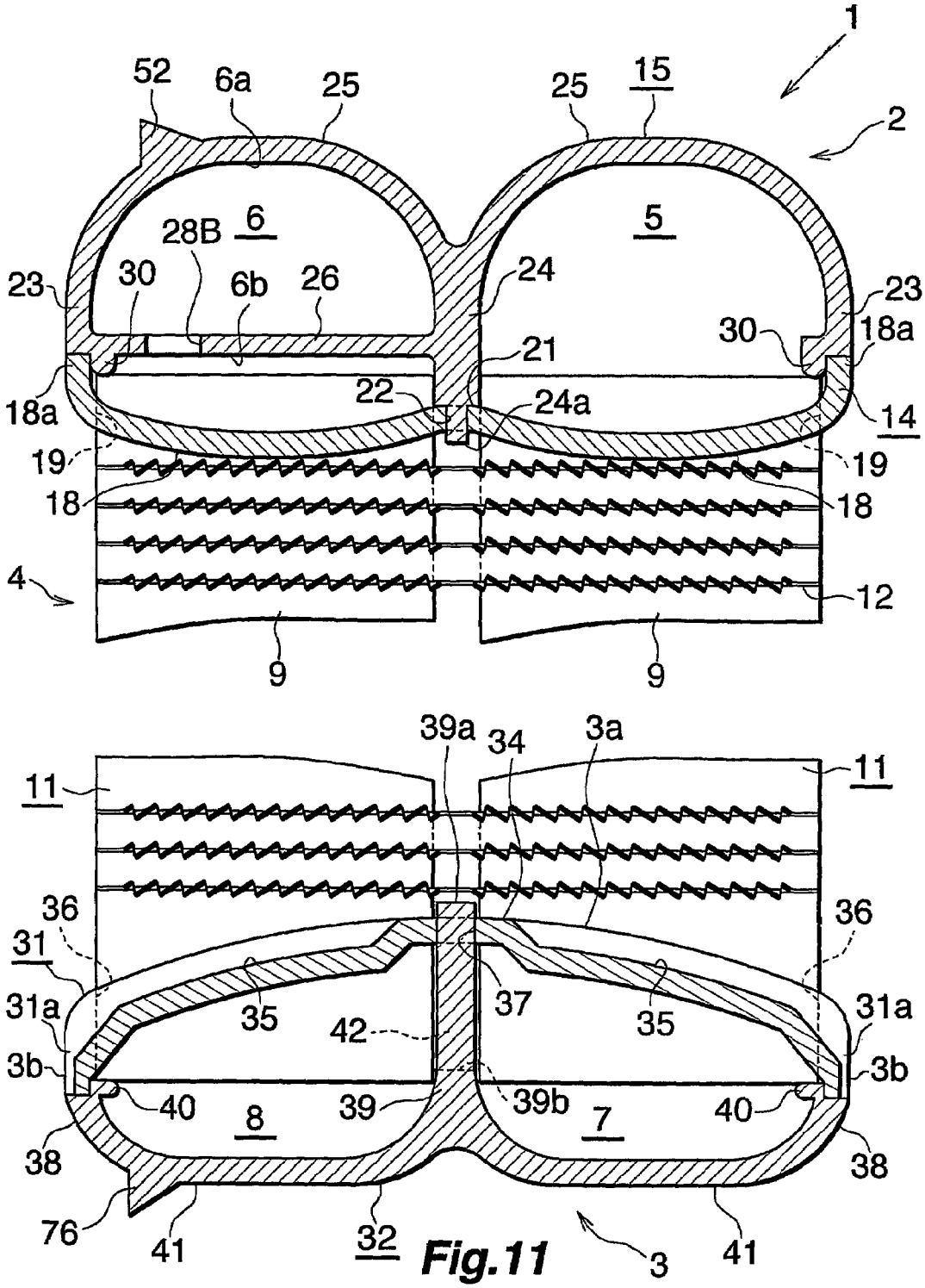
FIG. 11 is an enlarged view in section taken along the line B-B in FIG. 10 and partly broken away.
Figure 12:
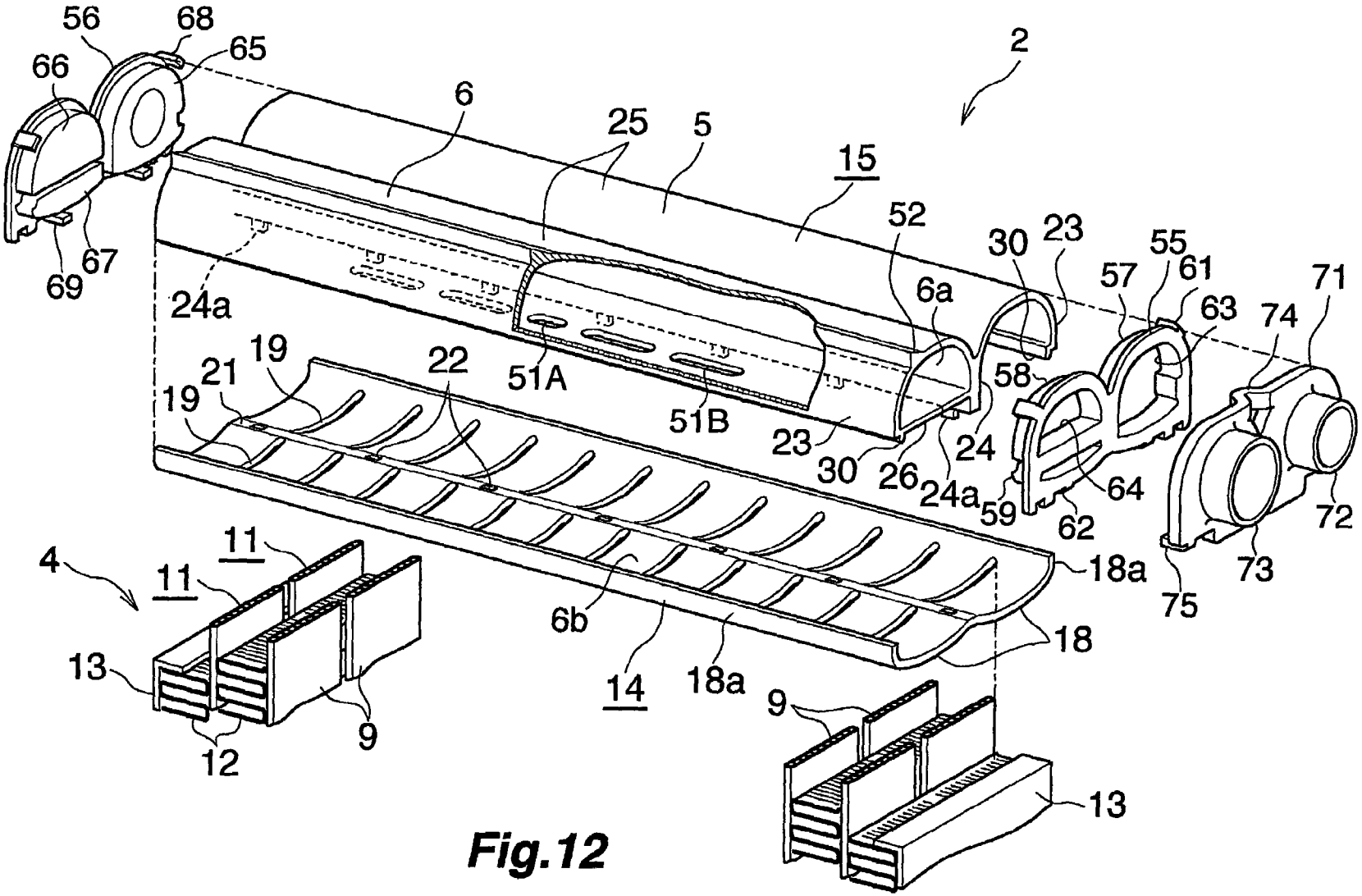
FIG. 12 is an exploded perspective view of a refrigerant inlet-outlet header tank of the evaporator shown in FIG. 10.
Figure 13:
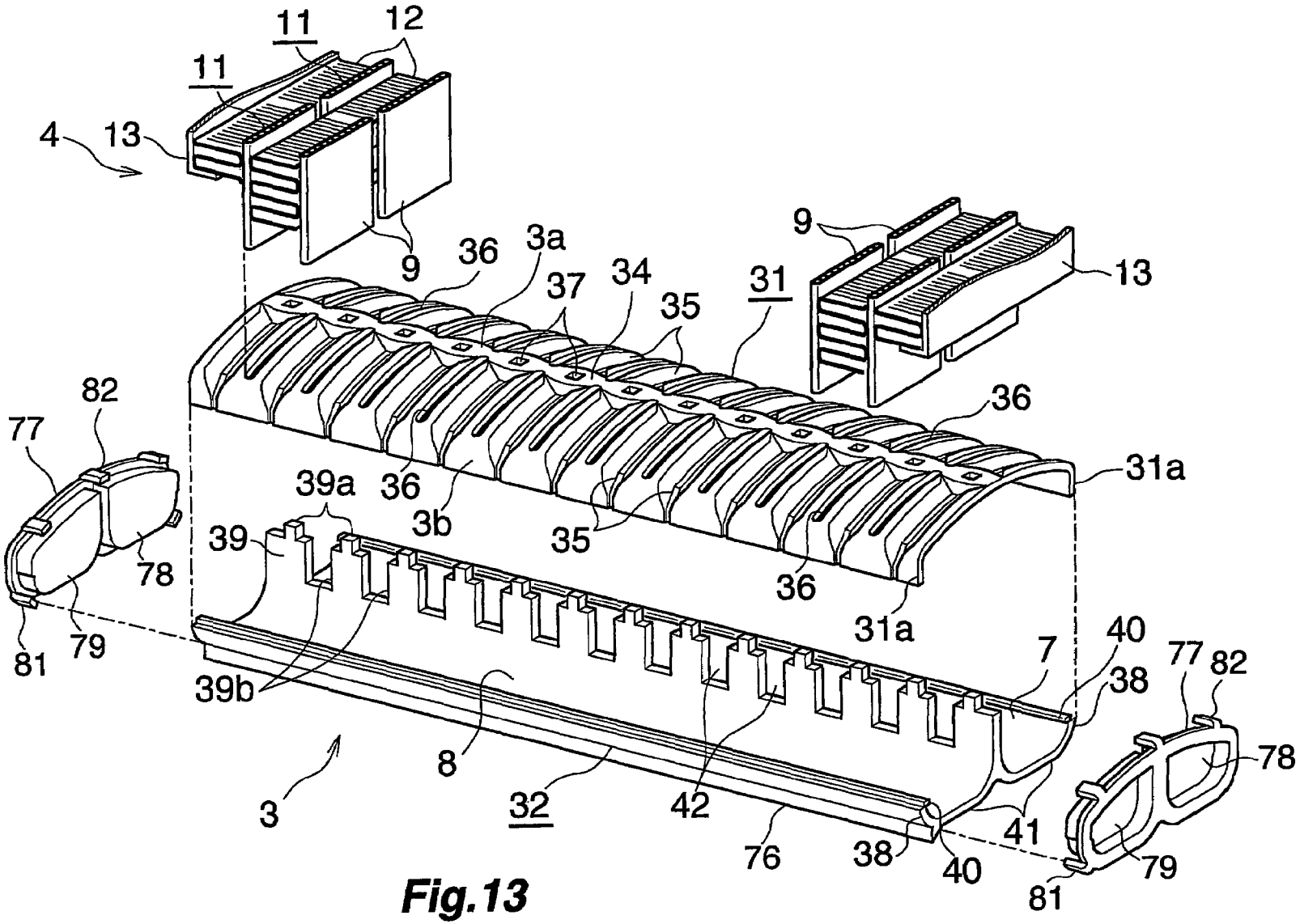
FIG. 13 is an exploded perspective view of a refrigerant turn header tank of the evaporator shown in FIG. 10.

FIGS. 10 and 11 show the overall construction of the evaporator, and FIGS. 12 and 13 show the constructions of main portions.

In the case of the embodiment shown in FIGS. 10 to 13, the flow dividing resistance plate 26 of the second member 15 of the refrigerant inlet-outlet header tank 2 has a plurality of laterally elongated refrigerant passing holes 51A, 51B arranged at a spacing in the lateral direction and formed in the rear portion of the plate 26 except the left and right end portions thereof, instead of the refrigerant passing holes 27A, 27B, 27C, 27D which are different in shape and/or size. The hole 51A in the center is shorter than the other holes 51B.

One of the two generally circular-arc connecting walls 25 of the second member 15, i.e., the rear connecting wall 25, is integrally provided on the outer surface thereof with a ridge 52 extending longitudinally of the wall and positioned away form the center thereof with respect to the forward or rearward direction, in place of the identification marks 28A, 28B, 28C, 18D provided on the outer surface of the connecting wall 25. The presence of the ridge 52 renders the front and rear portions of the second member 15, i.e., of the refrigerant inlet-outlet header tank 2, a symmetric in cross sectional contour. Except for the ridge 52, the front and rear portions of the second member 15, as well as of the header tank 2, are symmetric in cross sectional contour.

The second member 15 is produced by extruding the front and rear walls 23, partition wall 24, connecting walls 25, flow dividing resistance plate 26, tube bearing ridges 30 and ridge 52 in the form of an integral member, thereafter subjecting the extrudate to press work to form the refrigerant passing holes 51A, 51B in the resistance plate 26, and further cutting the partition wall 24 to form the projections 24*a*.

A refrigerant inlet pipe 53 of aluminum is connected to the inlet header 5 of the refrigerant inlet-outlet header tank 2, and a refrigerant outlet pipe 54 of aluminum to the outlet header 6 of the tank 2.

Caps 55, 56 for closing opposite end openings of the inlet-outlet header tank 2 are made from an aluminum brazing sheet having a brazing material layer over opposite surfaces thereof as by press work, forging or cutting. The right cap 55 has a leftward protrusion 57 formed integrally therewith on the front portion of its left side and to be fitted into the inlet header 5, and is integrally provided, on the rear portion of its left side, with an upper leftward protrusion 58 to be fitted into the upper space 6*a* of the outlet header 6 and with a lower leftward protrusion 59 to be fitted into the lower space 6*b* of the header 6. The right cap 55 has an engaging lug 61 projecting leftward and formed integrally therewith on a circular-arc portion between its upper edge and each of the front and rear side edges thereof. The right cap 55 further has an engaging lug 62 projecting leftward and formed integrally therewith on each of front and rear portions of its lower edge. A refrigerant inlet 63 is formed in the bottom wall of the leftward protrusion 57 on the front portion of the right cap 55, and a refrigerant outlet 64 is formed in the bottom wall of the upper leftward protrusion 58 on the rear portion of the cap 55. The left cap 56 is symmetric to the right cap 55 and has formed integrally therewith a rightward protrusion 65 fittable into the inlet header 5, an upper rightward protrusion 66 fittable into the upper space 6*a* of the outlet header 6, a lower rightward protrusion 67 fittable into the lower space 6*b* of the header 6 and upper and lower engaging lugs 68, 69 projecting rightward. No opening is formed in the leftward protrusion 65 or in the upper rightward protrusion 66.

Brazed to the outer side of the right cap 55 is a forwardly or rearwardly elongated joint plate 71 made of a bare aluminum material and extending over both the inlet and outlet headers 5, 6. The refrigerant inlet pipe 53 and outlet pipe 54 are joined to the joint plate 71.

The joint plate 71 has a refrigerant inlet member 72 in the form of a short cylinder and communicating with the inlet 63 of the right cap 55 and a refrigerant outlet member 73 in the form of a short cylinder and communicating with the outlet 64 of the cap. A bent portion 74 projecting leftward is formed in each of upper and lower edges of the joint plate 71 between the inlet member 72 and the outlet member 73. The upper and lower bent portions 74 are engaged in the tank 2 between the inlet header 5 and the outlet header 6. The joint plate 71 has an engaging lug 75 projecting leftward and formed integrally therewith at each of the front and rear ends of its lower edge. The lug 75 is in engagement with the lower edge of the right cap 55.

The first and second members 14, 15 of the refrigerant inlet-outlet tank 2, the two caps 55, 56 and the joint plate 71 are brazed together in the following manner. The first and second members 14, 15 are brazed to each other in the same manner as in the foregoing first embodiment. The caps 55, 56 are brazed to the first and second members 14, 15 utilizing the brazing material layer of the caps 55, 56, with the front protrusions 57, 65 fitting in the front space inside the two members 14, 15 forwardly of the partition wall 24, with the rear upper protrusions 58, 66 fitting in the upper space inside the two members 14, 15 rearwardly of the partition wall 24 and above the resistance plate 26, with the rear lower protrusions 59, 67 fitting in the lower space rearwardly of the partition wall 24 and below the resistance plate 26, with the upper engaging lugs 61, 68 engaged with the connecting walls 25 of the second member 15, and with the lower engaging lugs 62, 69 engaged with the curved portions 18 of the first member 14. The joint plate 71 is brazed to the right cap 55 utilizing the brazing material layer of the cap 55, with the upper bent portion 74 engaged with the right cap 55 at the midportion thereof with respect to the forward or rearward direction and with the second member 15 at the portion thereof between the two connecting walls 25, with the lower bent portion 74 engaged with the right cap 55 at the midportion thereof with respect to the forward or rearward direction and with the flat portion 21 of the first member 14, and further with the engaging lugs 75 engaged with the lower edge of the right cap 55.

In this way, the refrigerant header tank 2 is made. The inlet member 72 of the joint plate 71 is held in communication with the inlet header 5 via the inlet 63 of the right cap 55, and the outlet member 73 is held in communication with the outlet header 6 via the outlet 64.

One of the two connecting walls 41 of the second member 32 of the turn header tank 3, i.e., the rear connecting wall 41, is integrally provided with a ridge 76 extending longitudinally thereof and positioned on the outer surface of the wall away from the center of the second member 32 with respect to the forward or rearward direction. The provision of the ridge 76 renders the front and rear portions of the second member 32, i.e., of the turn header tank 3, asymmetric in cross sectional contour. Except for the ridge 76, the front and rear portions of the second member 32, as well as those of the turn header tank 3, are symmetric in cross sectional contour.

The second member 32 is fabricated by extruding the front and rear walls 38, partition wall 39, connecting walls 41, tube bearing ridges 40 and ridge 76 in the form of an integral member and thereafter cutting the partition wall 39 to form the projections 39*a* and cutouts 39*b*.

Caps 77 for closing opposite end openings of the refrigerant turn header tank 3 is made from an aluminum brazing sheet as by press work, forging or cutting. Each cap 77 has a laterally inward protrusion 78 formed integrally therewith on the front portion of its laterally inner side and fittable into the inflow header 7, and is integrally provided, on the rear portion of its inner side, with a laterally inward protrusion 79 fittable into the outflow header 8. Each cap 77 has an engaging lug 81 projecting laterally inward and formed integrally therewith on a circular-arc portion between its lower edge and each of the front and rear side edges thereof, and is integrally provided with a plurality of engaging lug 82 projecting upward from its upper edge, extending laterally inward and arranged at a spacing in the forward or rearward direction.

Each cap 77 of the refrigerant turn header tank 3 is brazed to the first and second members 31, 32 utilizing the brazing material layer of the cap 77, with the front protrusion 78 fitting in the front space defined by the two members 31, 32 and positioned forwardly of the partition wall 39, with the rear protrusion 79 fitting in the rear space defined by the two members 31, 32 and positioned rearwardly of the wall 39, with the upper engaging lugs 82 engaged with the first member 31, and with the lower engaging lugs 81 engaged with the respective front and rear walls 38 of the second member 32.

With the exception of the above features, the second embodiment is the same as the evaporator of the first embodiment.

Figure 14:
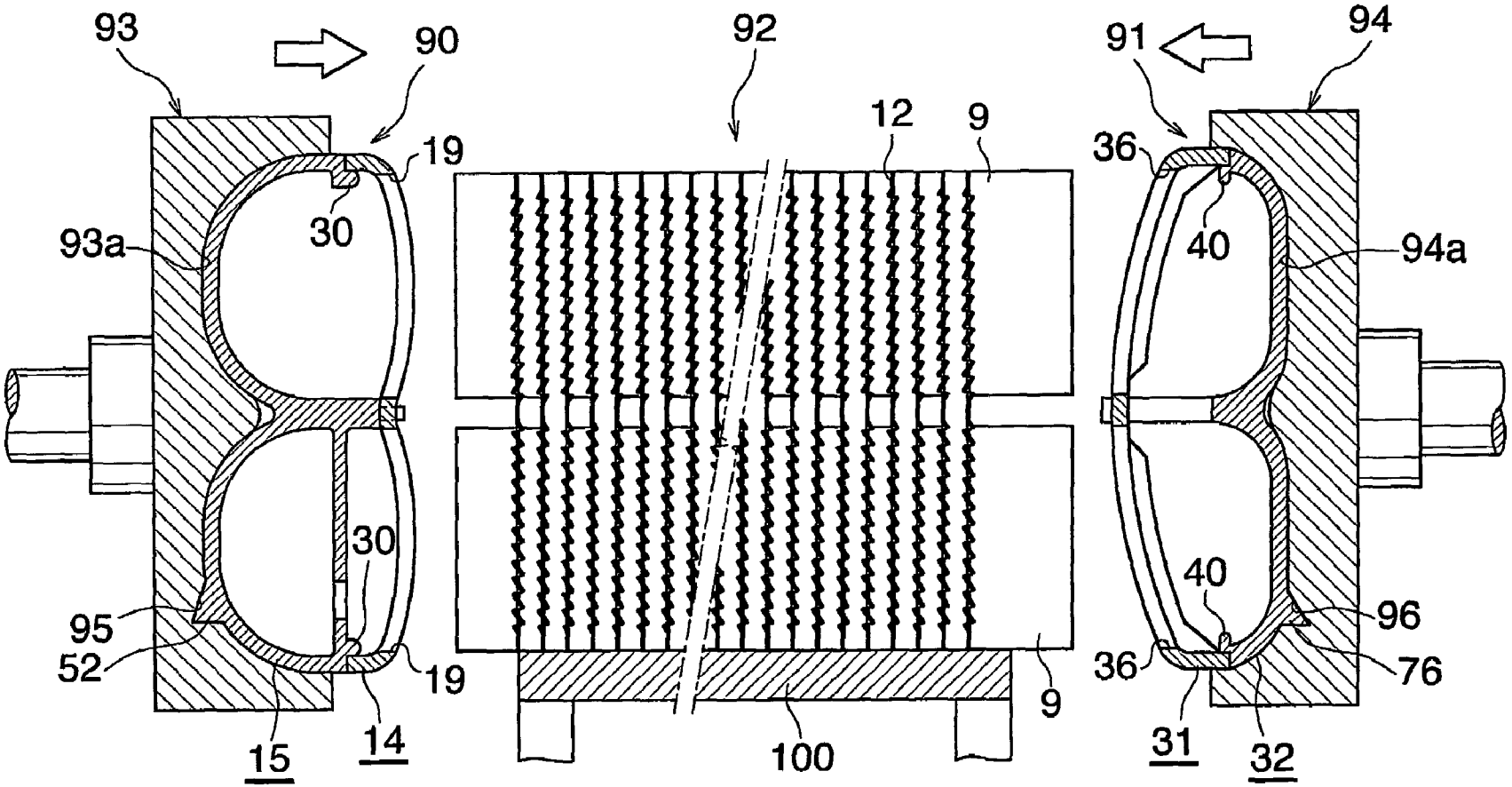
FIG. 14 is a diagram showing part of a process for fabricating the evaporator shown in FIG. 10.

FIG. 14 shows a process for fabricating the evaporator 1 of the second embodiment.

First, the first member 14 and the second member 15 are tacked together by inserting the projections 24*a* of the second member 15 through the respective holes 22 of the first member 15 in crimping engagement to thereby bring the upper end faces of the front and rear upstanding walls 18*a* of the first member 14 into contact with the lower end faces of the front and rear walls 23 of the second member 15 and bring the inner faces of the front and rear upstanding walls 18*a* into contact with the outer faces of the front and rear tube bearing ridges 30. The two caps 55, 56 are tacked to the first and second members 14, 15 by fitting the front protrusions 57, 65 into the front space inside the two members 14, 15 forwardly of the partition wall 24, the rear upper protrusions 58, 66 into the upper space inside the two members 14, 15 rearwardly of the partition wall 24 and above the resistance plate 26, and the rear lower protrusions 59, 67 into the lower space rearwardly of the partition wall 24 and below the resistance plate 26, and engaging the upper engaging lugs 61, 68 with the connecting walls 25 of the second member 15, and the lower engaging lugs 62, 69 with the curved portions 18 of the first member 14. The joint plate 71 is tacked to the two members 14, 15 and to the right cap 55 by engaging the upper bent portion 74 with the right cap 55 at the midportion thereof with respect to the forward or rearward direction and with the second member 15 at the portion thereof between the two connecting walls 25, engaging the lower bent portion 74 with the right cap 55 at the midportion thereof with respect to the forward or rearward direction and with the flat portion 21 of the first member 14, and further engaging the engaging lugs 75 with the lower edge of the right cap 55. In this way, a tacked assembly 90 of refrigerant inlet-outlet header tank is made.

On the other hand, the first member 31 and the second member 32 are tacked together by inserting the projections 39*a* of the second member 32 through the respective holes 37 in crimping engagement to thereby bring the lower end faces of the front and rear depending walls 31*a* of the first member 31 into contact with the upper end faces of the front and rear walls 38 of the second member 32 and bring the inner faces of the front and rear depending walls 31*a* into contact with the outer faces of the front and rear tube bearing ridges 40. Each cap 77 is tacked to the first and second members 31, 32 by fitting the front protrusion 78 into the front space defined by the two members 31, 32 and positioned forwardly of the partition wall 39, and the rear protrusion 79 into the rear space defined by the two members 31, 32 and positioned rearwardly of the wall 39, and engaging the upper engaging lugs 82 with the first member 31, and the lower engaging lugs 81 with the respective front and rear walls 38 of the second member 32. In this way, a tacked assembly 91 of refrigerant turn header tank is made.

Subsequently, an assembly 92 of heat exchange core is made by arranging a plurality of heat exchange tubes 9 and corrugated fins 12 on a bed 100 and arranging side plates 13 externally of the corrugated fins 12 at opposite ends of the arrangement.

The tacked assembly 90 of inlet-outlet header tank and the tacked assembly 91 of turn header tank are then arranged respectively on opposite sides of the heat exchange core assembly 92, the tacked assemblies 90, 91 are moved toward the core assembly 92 by forwardly or rearwardly movable jigs 93, 94 to insert the opposite ends of the heat exchange tubes 9 through the tube insertion slits 19, 36 of the respective first members 14, 31 into bearing contact with the tube bearing ridges 30, 40. The jigs 93, 94 have recessed portions 93*a*, 94*a* for the outer portions of the tacked tank assemblies 90, 91 to fit in. Further grooves 95, 96 for the respective ridges 52, 76 to fit in are formed in the inner peripheral surfaces of the recessed portions 93*a*, 94*a* of the jigs 93, 94.

The tacked tank assemblies 90, 91 and the core assembly 92 are thereafter tacked by suitable jig, and all the components are brazed collectively. In this way, the evaporator 1 is fabricated.

The second member 32 of the turn header tank 3 is provided with the ridge 76 on the outer surface thereof according to the second embodiment, whereas when the inflow header 7 and the outflow header 8 of the turn header tank 3 are identical in construction and when the refrigerant passing holes 42 formed in the left half of the partition wall 42 and those formed in the right half thereof are position symmetrically, there arises no problem if the header tank 3 is positioned as oriented longitudinally in the opposite direction. Accordingly, the ridge 76 need not always be provided.

Although the second member 15 or 32 providing the outer portion of the header tank 2 or 3 is made of an aluminum extrudate according to the foregoing second embodiment, the header tank may be made of an extrudate in its entirely for use in evaporators of other types or other heat exchangers such as condensers.

One group 11 of heat exchange tubes is provided between the inlet header 5 and the inflow header 7 of the two header tanks 2, 3, as well as between the outlet header 6 and the outflow header 8 thereof according to the foregoing two embodiments, whereas this arrangement is not limitative; one or at least two groups 11 of heat exchange tubes may be provided between the inlet header 5 and the inflow header 7 of the two header tanks 2, 3, as well as between the outlet header 6 and the outflow header 8 thereof. Although the refrigerant inlet-outlet header tank 2 is positioned above the refrigerant turn header tank 3 which is at a lower level according to the foregoing embodiments, the evaporator may be used conversely with the turn header tank 3 positioned above the inlet-outlet header tank 2.

Although the heat exchanger of the invention is used as an evaporator in the case of the above two embodiments, this use is not limitative; the prevent invention can be embodied as various other heat exchangers such as condensers.

Furthermore, the heat exchanger of the invention may be used in vehicles, such as motor vehicles, equipped with an air conditioner which has a compressor, gas cooler, intermediate heat exchanger, expansion valve and evaporator and wherein $CO_2$ refrigerant is used, as the gas cooler or evaporator of the air conditioner.

INDUSTRIAL APPLICABILITY

The heat exchanger of the invention is suitable for use as an evaporator for motor vehicle air conditioners and exhibits improved heat exchange efficiency.

The invention claimed is:

1. A heat exchanger comprising:

a first header tank;

a second header tank arranged as spaced apart from the header tank; and a plurality of heat exchange tubes arranged in parallel between the two header tanks and having opposite ends joined to the respective header tanks, at least one of the header tanks having a front portion and a rear portion which are asymmetric in cross sectional contour, wherein the first header tank has an interior divided by a partition wall into a front and a rear portion to provide a refrigerant inlet header and a refrigerant outlet header respectively, the second header tank has an interior divided by a partition wall into a front and a rear portion to provide two intermediate headers, the plurality of heat exchange tubes includes heat exchange tubes arranged in parallel between the inlet header and one of the intermediate headers and having opposite ends joined to the respective headers, the other heat exchange tubes are arranged in parallel between the outlet header and the other intermediate header and having opposite ends joined to the respective headers, each of the header tanks comprises a first member having the heat exchange tubes joined thereto and a second member made of an extrudate and brazed to the first member at a portion thereof opposite to the heat exchange tubes, the second member of at least one of the header tanks is integrally provided with a ridge positioned on an outer surface of the second member away from a center thereof with respect to the forward or rearward direction and extending longitudinally thereof, the second member having a front portion and a rear portion which are symmetric except the ridge in cross sectional contour, the ridge is provided on the outer surface of the second member of the first header tank, the outlet header has interior partitioned into two spaces by a flow dividing resistance plate, said other heat exchange tubes are joined to the outlet header in communication with one of the spaces, the resistance plate has a refrigerant passing hole formed therein, and the partition wall and the resistance plate are formed integrally with the second member.

2. A process for fabricating a heat exchanger according to claim 1, comprising including assembling the header tanks as held by a jig and the heat exchange tubes, the jig having a recessed portion for an outer portion of each header tank to fit in.

3. A process for fabricating a heat exchanger according to claim 1, comprising including assembling the header tanks as held by a jig and the heat exchange tubes, the jig having a recessed portion for an outer portion of each header tank to fit in, the recessed portion for at least one of the header tanks having a groove formed in an inner peripheral surface thereof and extending longitudinally thereof for the ridge to fit in.

4. A refrigeration cycle comprising a compressor, a condenser and an evaporator, the evaporator being a heat exchanger according to claim 1.

5. A vehicle having installed therein a refrigeration cycle according to claim 4 as an air conditioner.

* * * * *